US005243812A

United States Patent [19]

Strobel et al.

[11] Patent Number: 5,243,812

[45] Date of Patent: Sep. 14, 1993

[54] DEVICE FOR THE PIECING OF A YARN IN A OPEN-END SPINNING MACHINE OPERATING WITH A SPINNING ROTOR

[75] Inventors: Michael Strobel, Munich; Edmund Schuller, Ingolstadt, both of Fed. Rep. of Germany

[73] Assignee: Schubert & Salzer Maschinenfabrik AG, Ingolstadt, Fed. Rep. of Germany

[21] Appl. No.: 893,192

[22] Filed: Jun. 2, 1992

Related U.S. Application Data

[62] Division of Ser. No. 511,590, Apr. 18, 1990, Pat. No. 5,152,132.

[30] Foreign Application Priority Data

May 5, 1989 [DE] Fed. Rep. of Germany ..... 3914752
Nov. 4, 1989 [DE] Fed. Rep. of Germany ..... 3936748

[51] Int. Cl.[5] ..... D01H 4/50

[52] U.S. Cl. ..... 57/263; 57/93; 57/105

[58] Field of Search ..... 57/263, 104, 105, 264, 57/406, 93

[56] References Cited

U.S. PATENT DOCUMENTS 3,791,128 2/1974 Landwehrkamp et al. .
3,892,062 7/1975 Stahlecker et al. .
4,163,359 8/1979 Honjo ..... 57/105 X
4,760,688 8/1988 Beitzinger ..... 57/263 X
4,899,528 2/1990 Fahmuller et al. ..... 57/263 X

FOREIGN PATENT DOCUMENTS 2044807 10/1980 United Kingdom .

*Primary Examiner*—Joseph J. Hail, III
*Attorney, Agent, or Firm*—Dority & Manning

[57] ABSTRACT

A yarn is fed at a piecing speed to the fiber collection surface of a spinning rotor. It is there combined with the fibers of a fiber ring and is then drawn off from the spinning rotor in the form of a continuous yarn while fibers newly fed into the spinning rotor continue to be incorporated in the yarn. The rotor speed is changed, immediately after piecing, from the piecing speed to a rotational speed which is lower than the piecing speed. The rotor speed is then increased to the production speed. In this manner, optimal conditions are achieved with respect to propagation of twist and draw-off of the piecing joint. To carry out this process, elements are provided for the reduction of the rotor speed from piecing speed to a lower value, for renewed acceleration of the rotor speed after a desired minimum value has been reached of after the passage of a predetermined period of time, as well as elements to tie the accelerating rotor speed to the desired production speed.

22 Claims, 13 Drawing Sheets

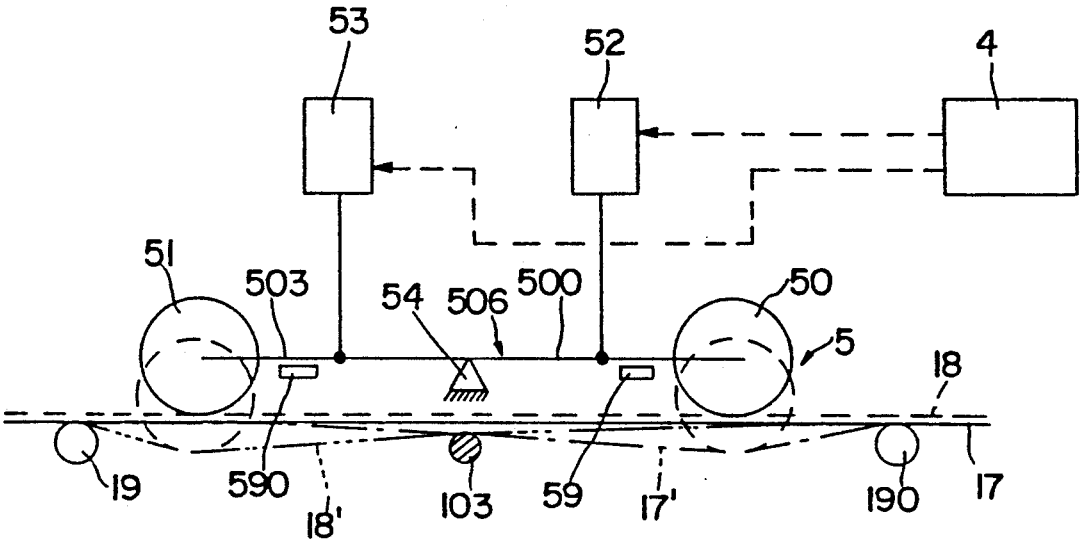
FIG.12
FIG.6a →
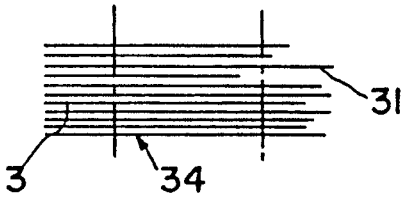
FIG.6b →
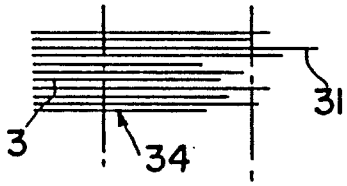
FIG.6c →
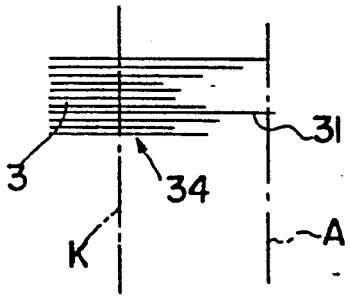

DEVICE FOR THE PIECING OF A YARN IN A OPEN-END SPINNING MACHINE OPERATING WITH A SPINNING ROTOR

This is a division of application Ser. No. 07/511,590 filed Apr. 18, 1990 now U.S. Pat. No. 5,152,132.

The instant invention relates to a process for the piecing-up of a yarn in an open-end spinning machine operating with a spinning rotor, in which a yarn end is delivered at the piecing-up speed of the spinning rotor to its fiber collection surface. It is there combined with the fibers of a fiber ring and then drawn-off again while fibers newly fed into the spinning rotor are continuously integrated into the yarn, as well as a device to carry out this process.

Rotor spinning devices run at extremely high rotor speeds of 100,000 rpm's and more. Spinning of the yarn is carried out at the highest possible production speed to which the spinning conditions are adapted as a function of the fiber material through the selection of spinning rotor, yarn draw-off nozzle, etc.

In practice, piecing-up is normally carried out at lower rotor speeds, which are kept constant for the duration of the piecing process (as in German patent publication No. DE-OS 2,058,604). Piecing-up can also be initiated at a lower rotor speed through which the spinning rotor goes as it runs up from stoppage (as in German Patent No. DE-PS 2,321,775). In both cases the rotor speed for the piecing-up is considerably different from the rotor speed for production, so that optimal spinning conditions do not prevail in this critical phase of the operation. It is, therefore, often necessary to select the spinning rotor and the yarn draw-off nozzle in adaptation to these low rotor speeds, and as a result the desired, high rotor speeds can no longer be kept up during production. In the second instance, the piecing-up conditions become even more critical because of the increasing rotor speed.

SUMMARY OF THE INVENTION

It is an object of the instant invention to provide a process and a device to increase the reliability of piecing-up.

This object is attained through the invention in that the rotor speed is brought from piecing-up speed to a rotational speed which is lower than the piecing-up speed, and only thereafter is the rotor speed increased, once more, to production speed. The piecing-up speed, at which contact is made between the piecing yarn end and the fiber ring, is, thereby, relatively high and may even coincide with the production speed of the rotor. This ensures that the required propagation of twist from the yarn segment which is in the yarn draw-off pipe into the overlap zone of yarn end and fiber ring, so that there is no danger, as in the present state of the prior art, for this twist to be uncontrolled or even absent. The relatively high rotor speed during piecing-up, i.e. during the back-feeding of the piecing yarn end to the fiber collection surface results in a high degree of resistance in the area of the piecing-up joint, due to the good propagation of twist, whereby yarn breakage can be counteracted or avoided. The fiber ring in the rotor continues to grow also after start of yarn draw-off beyond its normal size, until the yarn draw-off point has made one revolution in the spinning rotor. Since the rotor speed decreases after piecing-up the draw-off of the part of the fiber ring which increased in mass, the mass increase of the fiber ring is completely or at least extensively reduced by the speed reduction so that an essentially constant yarn tension is achieved during the draw-off of the joint from the spinning rotor. This counteracts the danger of yarn breakage because it ensures that yarn tension does not exceed admissible values.

The reduction of the rotor speed can be ended as a function of several different criteria, such as for example a function of the yarn tension, but it has been shown to be practical to end this reduction as a function of a preset time or as a function of a predetermined minimum rotor speed having been reached.

In order to be able to control piecing-up with particular precision, without the risk that the rotor speed may change in an uncontrollable manner because of different tolerances between the contact being made with the piecing yarn end and the fiber ring, the back-feeding of the piecing yarn end to the fiber collection surface should be kept temporarily constant and reduced only during the time between back-feeding of the piecing yarn end and onset of spun yarn draw off.

It is especially simple to control the piecing speed of the spinning rotor if it is accelerated from a full stop to a rotational speed greater than the piecing speed, and then reduced from that rotational speed to the rotational speed for piecing. In that case, this rotational speed, which is higher than the piecing speed and from which the rotor speed is reduced, may be the production speed or a rotational speed between production speed and piecing-up speed.

In order to reduce the speed of the spinning rotor rapidly from the piecing speed, in a further development of the process according to the invention, the lowering of the rotor speed is started at a rotational speed greater than the piecing speed and is continued during the piecing operation.

In principle it is possible to reduce the rotor speed for only so long as the heavy piecing joint has left the interior of the rotor and has entered the yarn draw-off pipe, where it is no longer subjected to the centrifugal forces of the rotor. However, it is desirable for the yarn segment which follows the piecing joint to meet production requirements as soon as possible, not only with respect to its mass but also with respect to its twist In order to a achieve this, provisions are preferably made, according to the instant invention, to continue to reduce the rotor speed after the draw-off of the portion of the fiber ring which increases in mass until the accelerating yarn draw-off speed and the decreasing rotor speed reach a certain desired ratio between them, whereupon the rotor speed and the yarn draw-off speed are both accelerated to production speed. With this desired ratio between rotor speed and yarn draw-off speed these may have reached essentially the same percentage value with respect to the applicable production values, but the desired ratio may differ from that which is indicated at production speed in order to produce a yarn segment at higher rotational speed while the rotor speed is still reduced.

The end of the reduction of rotor speed can be established empirically, and by this method, a rough adaptation to the yarn draw-off is achieved. This is sufficient in most instances. In order to achieve even more precise adaptation, another version of the process, according to the invention, can provide for the yarn draw-off speed to be monitored and when the rotor speed has reached the same percentage value of production speed value as the yarn draw-off speed the reduction of the rotor speed is ended.

To achieve proper twist in the yarn, not only at the end of the rotor speed change, and then only after reaching the production speed, but as soon as the same percentage values with respect to production conditions are reached in rotor speed and yarn draw-off speed, a preferred embodiment of the process provides for the desired ratio to be the same as it is at production speed, and that this ratio be maintained from the moment when this ratio has been reached, and also during the subsequent acceleration of the rotor speed to production speed. This can be determined empirically. It is, however, especially advantageous for the yarn draw-off speed to be monitored until it has reached its production value, and for the rotor speed to be accelerated in synchronization with the acceleration of yarn draw-off speed from the moment the rotor speed reaches the same percentage value as the yarn draw-off speed reaches full production value.

In practice, the spinning rotor is often driven by drive means which can be selectively brought in and out of driving engagement with the spinning rotor. In order to be able to change the rotor speed in a controlled manner in such a device, provisions are made in a preferred embodiment of the process according to the invention, to vary the slippage between the spinning rotor and drive means, which continue to run at its same speed.

The rotational speed change of the spinning rotor can be controlled in any desired manner. It has proven to be advantageous in a device with two drive means running at different speeds for the spinning rotor to be brought into driving engagement with the slower drive means for the reduction of its speed, and with the faster drive means for the increase of its speed. At the same time, the desired braking and/or acceleration of the spinning rotor can be achieved here through control of the slippage between the drive and the rotor.

In order to ensure that an excessive increase in yarn tension does not occur during draw-off of the piecing joint, even when the contact between back-fed yarn end and the fiber ring ensures good propagation of twist into said piecing joint at high rotor speed, it is preferred, according to the instant invention, to provide for a reduction in the rotor speed in two phases, with the first phase being essentially designed to achieve the desired yarn tension and the second phase being adapted to limit the yarn tension to the yarn tension tolerances. This reduction of the rotor speed in two phases is achieved when the reduction is caused or assisted by the action of a brake.

In another advantageous embodiment of the process according to the instant invention, the spinning rotor is separated from the drive means running at production speed and is connected to an auxiliary drive means which first slows down in accordance with the desired revolution of spinning rotor speed during piecing, and is again accelerated later until it reaches the production speed, whereupon the spinning rotor is separated from the auxiliary drive means and is connected to the drive means running at production speed.

To adjust not only the twist of the newly spun yarn but also the yarn thickness, as rapidly as possible, to the values of normal production, it is necessary to ascertain the state of the fiber tuft (which has been subjected in the uninterrupted spinning process of the fiber sliver to the action of the rotating opening roll) at the beginning of the piecing process and to effect the acceleration of the yarn draw-off speed and of the rotor speed as a function of the ascertained state of the fiber tuft.

The yarn does not always break when certain yarn tension values are exceeded, although the danger of yarn breakage in such cases is very high. In order to increase piecing-up reliability in subsequent piecing operations, of which the first could be carried out after the initiation of a yarn breakage directly following the above-explained piecing process, it is advantageous to monitor and record the yarn tension in the drawn-off yarn during piecing-up and, if a predetermined deviation from the yarn tension during normal production has been exceeded, to correct the reduction of the rotor speed during the next piecing-up operation in accordance with the recorded deviations.

The back-feeding of the piecing yarn end to the fiber ring is carried out, according to the invention, at a higher speed than the drawing off of the portion of the fiber ring which increases in mass. Thus, an increased twist is produced in the drawn-off yarn during the piecing process in the yarn segment between the inlet opening of the yarn draw-off pipe and the yarn draw-off device. To enable this twist to decrease before the yarn is wound up on the bobbin, it is advantageous, if during the time when the yarn draw-off speed has not yet reached its production value, the draw-off movement is imparted to the yarn at a greater distance from the spinning rotor than after reaching the production value. In this way the twist can be distributed over a greater yarn length so that the wound-up yarn is given a twist which does not exceed the normal twist values or exceeds them only insignificantly, despite the increased twist being imparted during piecing.

To carry out the described process, means for the reduction of the rotor speed from the piecing speed to a lower value, and means for resuming acceleration of the rotor speed after reaching a desired minimum value or after a predetermined time period provided therefor, as well as means to link the accelerating rotor speed to the desired production speed are provided in a machine of this type. Thereby, in coordination with the piecing of the yarn and the drawing off of the piecing joint, the spinning rotor can be ensured the desired the rotational speed.

According to a preferred embodiment of the device, according to the invention, a control device with a time control system is provided by means of which it is possible to control the reduction and resumed acceleration of the rotor speed and the back-feeding of the yarn end to the fiber collection surface in such manner that the yarn end reaches the fiber collection surface at a rotor speed which is greater than during the subsequent drawing-off of the fiber ring (which is present in the spinning rotor partly before the beginning of draw-off). This time control means makes it possible for the rotor speed to be further reduced after the back-feeding of the piecing yarn end to the fiber collection surface so that the piecing joint may be given the desired solidity, on the one hand, and so that the yarn tension may not exceed preset values during drawing-off of the piecing joint, on the other hand.

In order to achieve not only improved piecing reliability but also to match the twist in the yarn as rapidly as possible to the desired twist, it is advantageous that the time control means is provided with adjusting means to determine the time period during which the rotor speed is reduced.

According to an alternate, advantageous embodiment of the device according to the invention, means to monitor the rotor speed or values proportional to the rotor speed are provided in order to prevent the rotational speed of the spinning rotor from falling below a preset minimum value. To be able to adapt the rotor speed as precisely as possible to the yarn draw-off speed, monitoring means to monitor the yarn draw-off speed or values proportional to that speed, means to convert the obtained measured values into percentage values of the applicable full production values as well as comparison means to compare the percentage values of yarn draw-off speed and rotor speed, and to trigger a switching impulse when matching percentage values have been reached in order to end the reduction of rotor speed are provided in addition to the means for the monitoring of the rotor speed or values that are proportional to that speed.

To ensure that the produced yarn has the same twist as during undisturbed production from the moment when the dropping rotor speed reaches the same percentage value, with respect to its operating speed, as the yarn draw-off begun after the back-feeding of the yarn and in the process of acceleration, the monitoring means, in another advantageous embodiment of the invention, is connected, for control, to means for the production of rotor speed that is in proportion to the yarn draw-off speed.

In a preferred embodiment of the device according to the invention, a belt application device is provided to change the rotor speed by means of a belt-driven spinning rotor. The belt application device is connected to the control device to change the contact pressure and the slippage between the belt and the rotor shaft.

Of special advantage here is a further embodiment of the invention in which the spinning rotor is driven selectively by one of two belts, each of which is capable of being driven at different speeds. At least one arm of a two-arm change-over lever causes the spinning rotor to be driven at lower speed, by means of which the spinning rotor can be brought into driving engagement with one or the other belt. In this manner, the reduction of rotational speed can be carried out more rapidly or more slowly, depending on the selected application pressure. If both arms of the change-over lever are made in form of belt application devices, the rotor acceleration is also controlled.

To be able to achieve easy control of the rotor deceleration or rotor acceleration, from the point of view of the change of speed, it is necessary to determine the application pressure between the belt and the spinning rotor or rotor shaft. For that purpose the belt application device is provided with an adjusting device to set the maximum or minimum application pressure between the belt and the rotor shaft. If a single belt is used, the minimum application pressure determines the speed reduction while the maximum application pressure determines the acceleration. Maximum application pressure also determines the rotor deceleration and rotor acceleration when this change in rotational speed is effected by means of two belts driven at different speeds.

In today's open-end spinning machines, a plurality of identical open-end spinning devices are installed next to each other and can be serviced by means of one or several service devices, traveling alongside the plurality of spinning devices. To enable the service unit to effect the rotational speed control of the spinning rotor easily, provisions are made for the belt application device to be connected to a control lever, to which actuating elements, controlled from the service unit are advanced.

To be able to limit and determine the lifting stroke and, thereby, the application pressure of the belt against the rotor or rotor shaft without having to respect very narrow tolerances between the service unit and the open-end spinning device, the open-end spinning device is equipped with a stop to limit the path of advance of the actuating element of the service unit.

It has been found that the rotor speed is easily controlled by controlling the slippage between the spinning rotor or its shaft and the drive means, which continue to run at the same speed. According to an embodiment of the instant invention particularly well-suited for this, a belt to drive the shaft-mounted spinning rotor and a belt application device are provided. The belt application device is equipped with a roller lever bearing a belt application roller, the roller lever being capable of being brought to bear with its belt application roller against the belt and being, furthermore, provided with a braking lever capable of being applied against the rotor shaft which, in addition to a braking position, can be brought into different relative positions with respect to the roller lever. The braking lever and the roller lever are provided with interacting stops by means of which the roller lever, with its belt application roller, can be lifted off from the belt when the braking lever moves into its braking position. The braking lever and the roller lever are connected to each other through an elastic element which is weaker than the first elastic element and by means of which, by changing the relative movement between braking lever and roller lever, the belt application pressure produced by the first elastic element can be reduced. Thereby, the slippage between the belt and the rotor shaft is controlled as a function of the relative position of the braking lever with respect to the roller lever. Depending on whether the spinning rotor is to be braked or its speed accelerated, this device can be used for the reduction as well as for the acceleration of the rotational speed of the spinning rotor if the rotor speed is not reduced after piecing, and this device, thus, has its own significance.

An embodiment of the device according to the invention in which the roller lever is equipped with two arms has been found to be especially advantageous, whereby one of these arms bears the belt application roller and is subjected to the force of the second elastic element, while the arm away from the belt application roller is subjected to the force of the first elastic element.

To control the acceleration according to another embodiment of the invention, a belt to drive the shaft-mounted spinning rotor as well as a belt application device is provided, with a roller lever bearing an belt application roller. This roller can be lifted off the rotor shaft by means of a braking lever and is provided with a controllable damping device. Such a damping device to control the acceleration of a spinning rotor is used whether or not the spinning motor's speed is reduced after piecing. Such a damping device has its own separate significance.

The damping device can be designed in different ways, e.g. in the form of a controllable hydraulic or pneumatic piston. In a preferred embodiment, the damping device is made in form of a Belleville spring washer mounted on the pivoting axle of the roller lever, to which a load element is assigned which can be adjusted parallel to the axle.

It is not necessary for the service unit to act mechanically upon the elements of the open-end spinning device for it to be able to control the rotor speed. In an alternate embodiment of the invention, it is possible to provide for the belt application device of each open-end spinning device to be provided with its own actuation device through which the belt application device is connected to the control device. This connection to the control device can be electrical, inductive or can be effected in some other appropriate manner, so that the appropriate control commands of the control device cause the belt application device to be actuated at the desired moment and in the desired manner.

Instead of, or in addition to, the belt application device, a brake with controllable braking action can also be provided, whereby it is possible to cause this brake to act upon the spinning rotor or upon the rotor shaft in the desired manner in order to achieve the desired change of the rotor speed.

In an another embodiment of the device according to the invention, a braking lever is provided which is actuated by a control element through an elastic element in the braking direction and through a fixed stop in the lift-off direction.

It is not necessary to drive the spinning rotor of each spinning station by means of a drive belt or similar device. The instant invention can also be realized if an individual drive motor is provided for the spinning rotor. In that case it is necessary to equip the control device with a generator to produce electrical values by means of which the rotational speed of the spinning rotor is controlled in the desired manner.

According to another embodiment of the instant invention, two drive means which are selectively brought to bear upon the spinning rotor are provided, whereby one of these drive means is used to drive a plurality of spinning rotors simultaneously, while the other merely serves to drive a single spinning rotor at a time. In that case it is necessary for the drive means for driving a single spinning rotor at a time to be connected to the control device and to be controlled by same.

When the yarn draw-off is controlled as a function of the combed-out state of the fiber tuft, a further embodiment of the instant invention provides for the control device to be connected to a device which ascertains the combed-out state of the fiber tuft at the moment of back-feeding the piecing yarn end to the collection surface in order to ensure early maintenance of the desired yarn twist, and for the control device to control not only the yarn draw off but also the rotor speed as a function of the ascertained combed-out state.

When preset values for the yarn tension are exceeded, this does not, necessarily, lead to yarn breakage, but the danger does exist that subsequent piecing attempts will fail. For this reason, a yarn tension measuring device to monitor the yarn tension is provided, whereby means for the comparison of the measured yarn tension with a predetermined reference tension, as well as means to change the data stored in the control device are provided in such manner that the reduction of the rotor speed during the next piecing process takes place so that the deviations in yarn tension may be reduced. In this embodiment of the invention it is necessary for the control device to contain means to store the average value of the yarn tension during undisturbed production as a reference value. In that case, separate adjusting means to enter the reference value are not necessary.

The instant invention, for the first time, offers a solution to the problem of meeting the contrary requirements for conditions, during the actual piecing operation, that are completely or, at least, to a great extent compatible with normal operating conditions, and of meeting the requirement of low yarn tensions, as the piecing joint, which has several times the normal yarn mass for the same lengths is being drawn off. At the same time, the device is of a simple construction and can be used in combination with all the conventional devices for driving the rotor. The instant invention thus makes it possible to increase the reliability of piecing-up of the yarn.

BRIEF DESCRIPTION OF THE DRAWINGS

Examples of embodiments of the invention are explained in greater detail below through drawings, in which:

FIG. 6 shows schematically a fiber tuft which has been exposed to the action of an opening roll for different periods of time after stoppage of the fiber sliver;

FIG. 12 shows schematically another embodiment of the rotor drive device according to the invention by means of which the reduction of the rotor speed as well as the following rotor speed can be controlled;

DETAILED DESCRIPTION OF THE INVENTION

Figure 1:
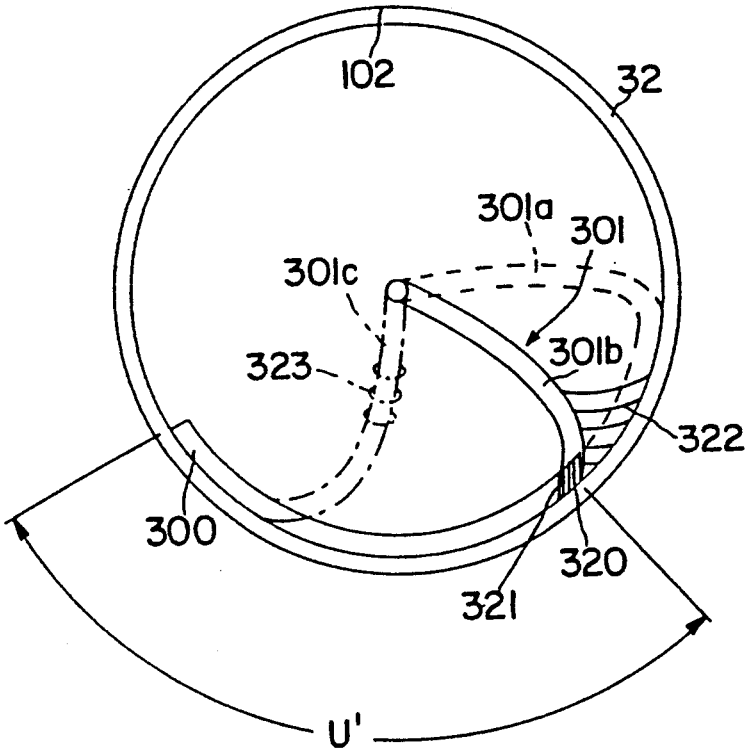
FIG. 1 shows schematically the piecing conditions in the spinning rotor.

The construction of an open-end spinning device 10 equipped with a spinning rotor 100 shall first be described with reference to FIG. 10, to serve as reference in the subsequent explanations of the problem to be solved.

The open-end spinning device 10 is part of an open-end spinning machine 1 alongside which a service unit 2 travels.

Each open-end spinning device 10 is provided with a fiber sliver feeding or delivery device 11 and an opening device 12. The fiber feeding device 11 comprises, in the embodiment shown, a feeding roll 110 with which the feeding tray 111 interacts resiliently. The feeding tray 111 is pivotably mounted on an axle 112 which also supports a clamping lever 113, which is made in form of a guiding element for a fiber sliver 3 and is brought to bear against the feeding tray 111 or can be lifted away from the tray by means of a solenoid 114. The opening device 12 in the embodiment shown in FIG. 10 is made in form of an opening roll 121 located in a housing 120. A fiber feeding channel 122 extends from housing 120 to the spinning rotor 100 from which the spun yarn 30 is drawn off through a yarn draw-off pipe 101.

The spinning rotor 100 is located in a housing (not shown) which is connected, for the production of the required negative spinning pressure, to a source of negative pressure (also not shown). The entire open-end spinning device 10, including the fiber feeding device 11 and the opening device 12 is covered by a cover 13 which can be opened.

To draw off the yarn 30 from the spinning rotor 100, during an undisturbed spinning process, a pair of draw-off rolls 14 with a draw-off roll 140 driven at production speed and with draw-off roll 141 resiliently bearing upon the driven draw-off roll 140 and driven by it. The yarn 30 is monitored by a yarn monitor 15 between the yarn draw-off pipe 101 and the pair of draw-off rolls 14.

The yarn 30 then reaches a winding device 16 equipped with a driven winding roll 160. The winding device 16 is furthermore provided with a pair of pivotable bobbin arms 161 which hold a bobbin 162 rotatably between them. The bobbin 162 bears upon the driven winding roll 160, in an undisturbed spinning process, and is driven by it. The yarn 30 to be wound up on the bobbin 162 is laid into a traverse guide 163 which is moved back and forth along the bobbin 162 and so ensures even distribution of the yarn 30 on the bobbin 162 during undisturbed operation.

The service unit 2, which travels alongside the open-end spinning machine 1, is equipped with a control device 20 which is connected to the pivot drive 210 of a pivoted arm 21 bearing an auxiliary drive roll 211 on its end. The auxiliary drive roll 211 is driven by a drive motor 212 which is also connected to the control device 20 for control.

Pivoted arms 22 which are also pivotably mounted on the service unit 2 and the drive 220 of which is connected to the control device 20 for control is moved towards the bobbin arms 161.

During undisturbed, normal production, the fiber sliver 3 is presented by means of the rotating feeding roll 110 and the feeding tray 11 to the opening roll 121 which opens the fiber sliver 3 into fibers 31. The fibers are conveyed, through the fiber feeding channel 122, into the interior of the spinning rotor 100 where they are deposited in form of a fiber ring 32. The yarn 30, in the process of being drawn off, is connected to fiber ring 32 and a twist is imparted to it by the rotation of the spinning rotor 100. This twist is propagated into the fiber collecting groove in which the fiber ring 32 forms, causing the fiber ring 32 to be twisted continuously into the end of a yarn 30 and to be integrated into it. The yarn 30 is drawn out of the spinning rotor 100 by means of the pair of draw-off rolls 14 and is wound up during production on the bobbin 162. The yarn 30 is distributed in pendulum-fashion by the traverse guide 163 on the bobbin 162 for even winding.

If yarn breakage occurs and is detected and recorded by the yarn monitor 15 through the absence or the decrease of yarn tension, the bobbin 162 is lifted off the driven winding roll 160 (by means not shown here), causing the bobbin 162 to be stopped. Furthermore, a control impulse is transmitted from yarn monitor 15 to solenoid 114, actuating clamping lever 113 and, thereby, clamping fiber sliver 3 between the clamping lever and feeding tray 111 In addition, this pivoting movement of the clamping lever 113 causes the feeding tray 111 to be pivoted away from the feeding roll 110 so that the fiber sliver 3 is no longer fed to the opening roll 121.

When service unit 2 has reached open-end spinning device 10, to be serviced in a known manner, whether it was called by a pager (not shown) or in the course of its normal patrol alongside the machine, the yarn breakage is repaired in the usual manner. For this, fiber feeding is resumed through reactuation of the solenoid 114 after the usual preparations (cleaning the spinning rotor 100, searching for the yarn end on the bobbin 162 and drawing off the yarn from it, cutting it to length and preparing the yarn end, and releasing the previously stopped spinning rotor 100), causing fibers 31 to re-enter the spinning rotor 100 to form a fiber ring 32 therein once more. At a point in time chosen for this, the yarn end is fed back onto the fiber collection surface 102 (which is in form of a fiber collection groove, see FIG. 1) of the spinning rotor 100, whereby the yarn end 300 is deposited over a section U' of the circumference U of the fiber collection surface and whereby its radial intermediary zone 301 assumes the position 301*a*. After remaining briefly on the fiber collection surface 102, the yarn end 300 is subjected (in a known manner) to a yarn draw-off process which accelerates to its production speed. At the same time, the yarn end 300 is put under tension and, together with its intermediary zone 301, goes into position 301*b*. In this process the intermediary zone 301 pulls on the fiber ring 32 so that fibers extend from the yarn end 300 to the fiber ring 32 and constitute fiber bridges 321 and 322 on both sides of the point of fiber integration 320, as seen in the direction of the circumference of the fiber collection surface 102. The fiber bridges 321 and 322 tear and wind themselves in the form of wild windings 323 around the yarn end 300. The size of the fiber bridges and, thereby, the size of the accumulation of windings 323 depend essentially on the size of the diameter of the spinning rotor 100.

Figure 2:
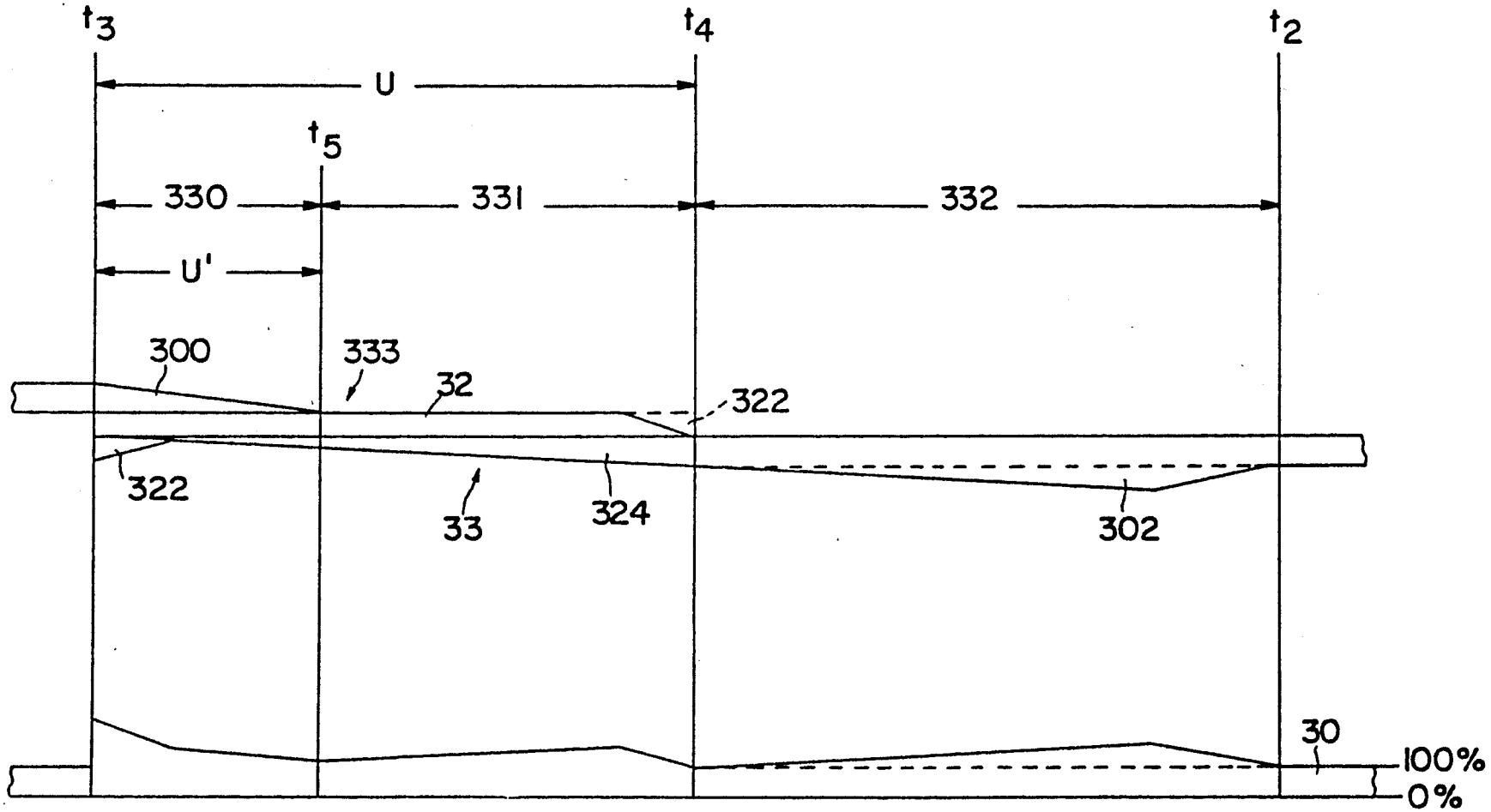
FIG. 2 shows schematically the changing of the mass in a piecing joint in the pieced yarn.

FIG. 2 shows a piecing joint 33 in two representations. As can clearly be seen from this Figure, the piecing joint 33 consists, as a rule, of three segments 330, 331 and 332.

The first segment 330 is formed by the overlap zone of the back-fed piecing yarn end 300 and the fiber ring 32 which is present in the spinning rotor 100 at the moment of yarn back-feeding. This first segment 330 also contains the wild windings 323 which are formed from the fiber bridge 322 (see FIG. 1). Since the fiber feeding device 11 continues to feed new fibers 31 on the fiber collection surface 102 to form fiber ring 32, the fiber ring 32 is reinforced by the newly fed fiber mass 324.

The second segment 331 of the piecing joint 33 also has a reinforced cross-section due to the fact that an additional fiber mass 324 reaches the spinning rotor 100, after the onset of yarn draw-off through the continued feeding of fibers 31. The fiber ring 32 has, as a rule, a mass in the spinning rotor 100, until completion of the first revolution of the point of fiber integration 320, which is greater than the mass after the first revolution of the point of fiber integration 320.

The first segment 330, which is formed by the overlap zone of the yarn end 300 and the fiber ring 32, has a length which is determined by the above-mentioned section U' of the circumference U of the spinning rotor 100. The two segments 330 and 331, together, have a length which is determined by the circumference U of the spinning rotor 100.

In the ideal case, i.e., when yarn speed and fiber feeding speed into the spinning rotor 100 are in synchronization after the segment 330 has been drawn off, the piecing joint 33 has already reached its desired thickness from the end of the segment 331 on, so that the third segment 332 is omitted. In other cases, however, a third segment 332, which is either thicker or thinner than the yarn 30 and may have different lengths, follows the two segments 330 and 331. The deviations of this segment 332 from the desired thickness of the yarn 30 depends on whether it was possible to bring fiber feeding and yarn draw-off to the same percentage value of their production values before the end of the segment 331.

Within the area of the segment 330, it is unavoidable for it to have a larger cross-section. This is due to the fact that in order to produce a secure link between yarn end 300 and fiber ring 32, the yarn end 300 and the fiber ring 32 must have sufficient mass. If the yarn end 300, which can be tapered in a known manner as a result of appropriate pre-treatment, does not have sufficient mass, a yarn breakage will occur in that area.

Figure 3:
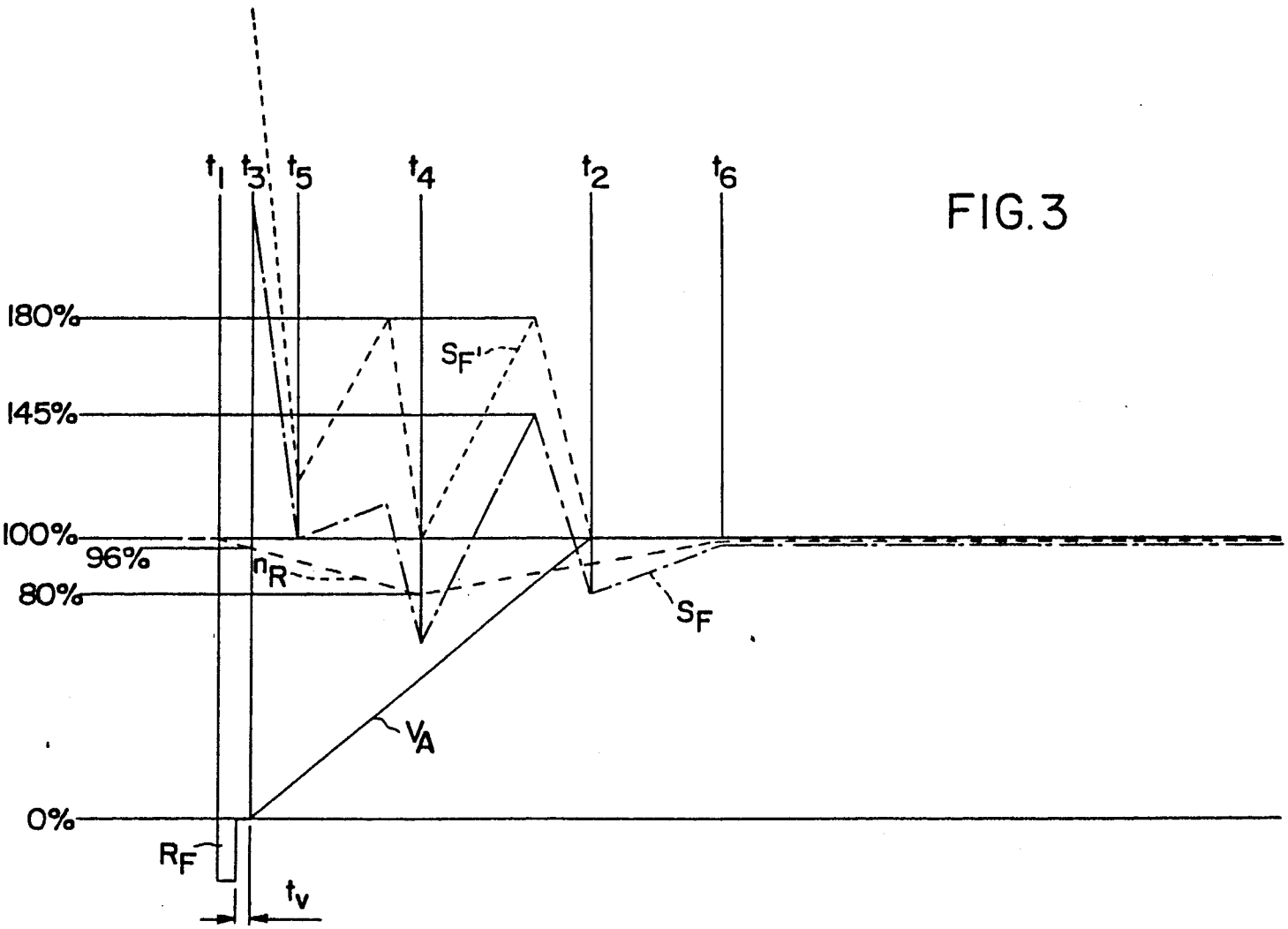
FIG. 3 shows schematically a comparison of the rotor speed, the yarn draw-off speed, and the yarn tension during the piecing process according to the invention.

If, on the other hand, the fiber ring 32 is not sufficiently strong, a second segment 331 starting with a thin spot will follow the segment 330, creating the danger of yarn breakage in that area 333. To remedy this, the road followed by the invention is different from the known state of the art, as seen in FIG. 3. This Figure shows schematically the speed $V_A$ of yarn draw-off as compared with the rotational speed $n_R$ of the spinning rotor 100 in percentages, with the base line representing 0% while the top limit line designates 100% of the applicable production speed or rotational speed. Only the path of the curve starting with point in time $t_1$, characterizing the back-feeding $R_F$ of the piecing yarn 300 to the fiber collection surface 102, is of interest in the description concerning the solution of the problem to be resolved. The course of the speed $V_A$ or of the rotational speed $n_R$ before point in time $t_1$ can be the usual one (therefore not shown). After back-feeding the yarn end 300 to the fiber collection surface 102, the yarn end 300 is subjected, after a brief pause, to yarn draw-off which now accelerates at increasing speed $V_A$ to the production speed (100%), attaining production speed at the point in time $t_2$.

Simultaneously with the back-feeding $R_F$ of yarn end 300 to the fiber collection surface 102, the reduction of the rotational speed $n_R$ of the spinning rotor 100 begins, so that the yarn end 300 reaches the fiber collection surface 102 of the spinning rotor 100 at a rotor speed which is higher than it is later, during the draw-off of the fiber ring 32 forming the piecing joint 33. At the point in time $t_3$ the reduction of the rotary speed is ended, whereupon the spinning rotor 100 is again accelerated to its full rotational speed $n_R$ (100%) which it attains, according to FIG. 3, at the point in time $t_6$, i.e. only after the yarn draw-off has reached full speed $V_A$.

At the beginning of the back-feeding of the yarn end 300 to the fiber collection surface 102, i.e., at the beginning of piecing, the piecing speed is still the same as the production speed. The spinning rotor 100 still runs at that point in time at its full rotational speed $n_R$ (100%) which, in the embodiment shown, is only approximately 94% of the full rotational speed (100%) at the beginning of yarn draw-off (see speed $V_A$). The reduction of the rotational speed $n_R$ is continued for a predetermined period of time, until a rotational speed lower than the piecing speed of the spinning rotor 100 is reached. In the embodiment shown, the reduction of the rotational speed is terminated as a function of time, i.e., at the point in time $t_4$ when the piecing joint 33 has entered the yarn draw-off pipe 101, so that no more radial forces may be produced in the yarn being drawn off as a result of the rotor's rotation. The spinning rotor 100 is then accelerated once more to its full rotational speed $n_R$.

The course of the cross-section of the newly pieced yarn is shown in the lower portion of FIG. 2. The tension $S_F$ in the yarn is calculated from the change of the cross-section of the yarn 30, taking into account the applicable rotational speed $n_R$ of the spinning rotor 100 and has been entered at the same scale on the lower portion of FIG. 2.

During the time $t_V$ when the yarn end 300 remains on the fiber collection surface 102 of the spinning rotor 100, the rotor is still running at almost its full rotational speed $n_R$. Thus, conditions in the spinning rotor 100 are still essentially the same as those prevailing during the normal production process. Thus, a certain number of true turns of twists in the yarn 30 is not only produced as a function of the number of rotor revolutions, but based on the high centrifugal forces which apply (see high yarn tension $S_F$), a high degree of false twist is also produced and is propagated to the point of integration 320, ensuring that a solid bond is produced between yarn end 300 and fiber ring 32.

At the beginning of the draw-off of the pieced joint 33, a sharp increase of tension $S_F$, a multiple of the yarn tension applied during normal spinning conditions takes place, even though the rotational speed $n_R$ of the spinning rotor 100 has been reduced to below the production speed. This tension peak is, however, unavoidable because of the required overlap of yarn end 300 and fiber ring 32. When segment 330 (at point in time $t_S$) has been drawn off, extensive compensation for the growing mass of the piecing joint 33 is achieved through continuous lowering of the rotational speed $n_R$ of the spinning rotor 100, so that the tension $S_F$ is kept essentially constant or at least remains within tolerable limits, so that no danger of yarn breakage exists due to the tension $S_F$.

When the piecing joint 33 has left the interior of the spinning rotor 100, the spinning rotor 100 is accelerated to its operating speed.

Figure 4:
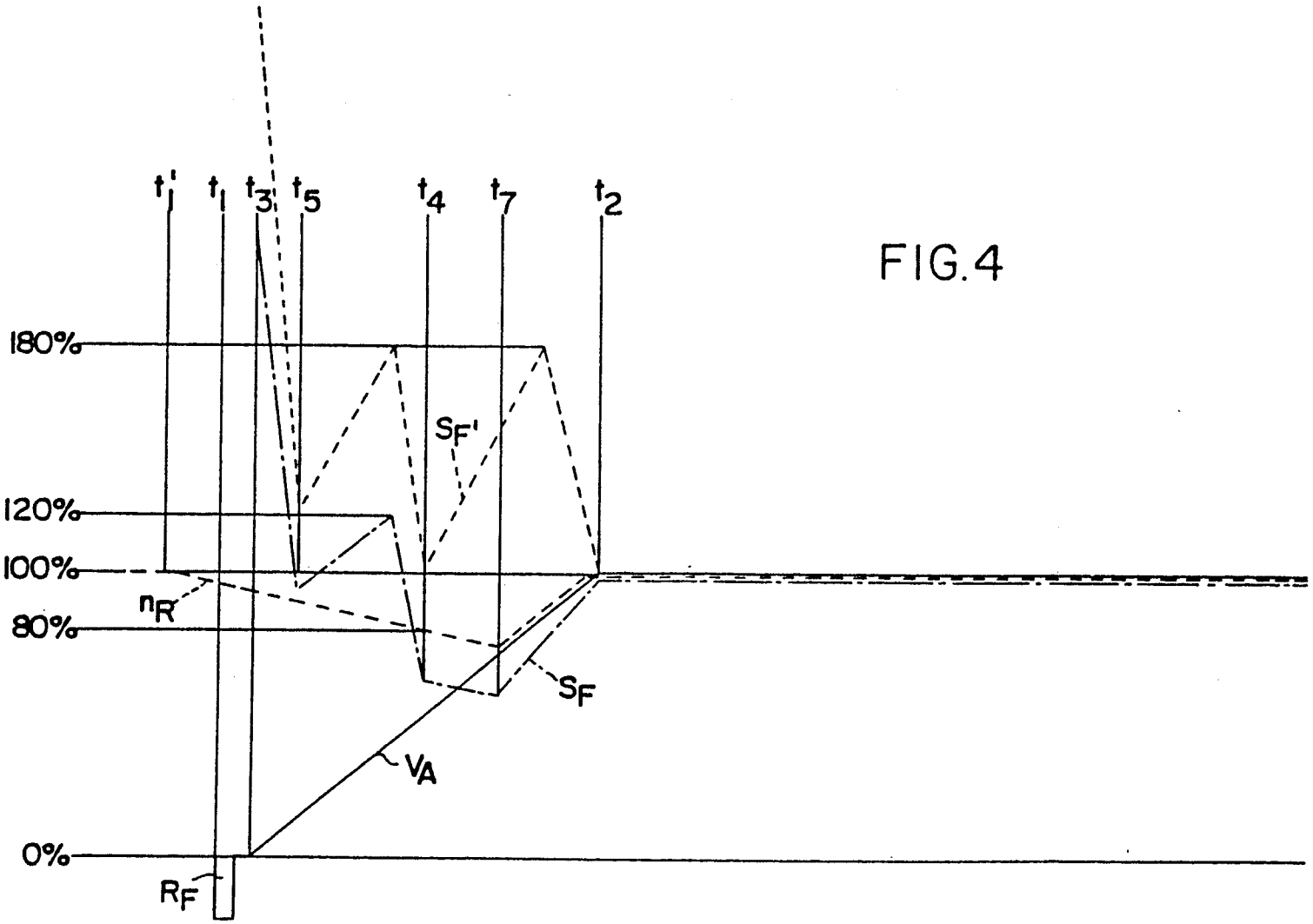
FIGS. 4 and 5 show schematically variations of the process shown in FIG. 3.

FIG. 4 shows a variant of the process described earlier through FIG. 3. The essential difference consists in the fact that the reduction of the rotational speed $n_R$ of the rotor starts (point in time $t_1$) before the yarn end 300 reaches fiber collection surface 102 of the spinning rotor 100, i.e. the reduction of the rotor speed begins with a rotor rotational speed that is greater than the piecing speed. The piecing speed is lower than the production speed in this modified process. Furthermore, the reduction of the rotational speed $n_R$ of the spinning rotor may possibly be continued even after the draw-off of the portion of the fiber ring, which increases in mass and grows until completion of the first revolution of the point of fiber integration 320, and, therefore, has a length equal to the circumference U, until the decreasing rotational speed $n_R$ of the spinning rotor 100 and the accelerating speed $V_A$ of the yarn draw-off have reached a desired ratio between them. This ratio is the same as for production speed of the spinning station. A different ratio than this may also be provided for, e.g., to produce a yarn segment with increased twist in order to compensate for the low rotor speed and also for the low centrifugal forces. If the desired ratio is to correspond to production conditions, the rotor speed and the yarn draw-off must have reached essentially the same percentage value (in relation to the applicable production values).

According to FIG. 4, the rotational speed $n_R$ of the spinning rotor 100 has already dropped to approximately 90% of the full rotational speed $n_R$ of the spinning rotor 100 at the beginning of yarn draw-off, so that the centrifugal forces acting upon the yarn 30 have already decreased considerably. Nevertheless, the rotor speed is near the production speed (100%), so that sufficient twist is imparted to the point of fiber integration 320 in order to ensure a secure link between yarn end 300 and fiber ring 32. A further drop in the rotational speed $n_R$ of the spinning rotor 100 produces a drop in yarn tension which is below normal spinning tension. The yarn tension increases briefly as long as the segment 331 is drawn off from the spinning rotor 100, and until the tension $S_F$ decreases once more towards the end of draw-off of this segment 331.

The reduction of the rotor speed is continued after the draw-off of the two segments 330 and 331 of the piecing joint 33, so that spinning rotor 100 may reach, as soon as possible, a rotational speed $n_R$ which corresponds (considered on a percentage basis) to the speed $V_A$ of the yarn draw-off.

In FIG. 2 the dotted lines in the segment 332 indicate that with a speed $V_A$ of the yarn draw-off, which is coordinated with the onset of fiber feeding in the spinning rotor 100, a thick spot in the yarn 30 is avoided so that the yarn 30 has its desired thickness as of point in time $t_4$. The continuing reduction of the rotational speed $n_R$ of the spinning rotor 100, beyond point in time $t_4$, makes it possible to obtain not only the desired thickness in the yarn 30 produced, but also the desired twist as of point in time $t_7$, when the rotational speed $n_R$ of the spinning rotor 100 and the speed $V_A$ of the yarn draw-off reach example shown, approximately 76% of production value).

When the desired ratio (which could be other than the ratio to the production speed) has been reached, the rotor speed and the yarn draw-off speed are accelerated. If the desired ratio already matches that of production speed, it will also be maintained during acceleration. If, however, the desired ratio is other than at production speed, adjustment of the ratio between rotor speed and yarn draw-off speed is effected during the joint acceleration of the yarn draw-off and the rotor speed. It is also possible to accept production conditions only when the yarn draw-off speed or the rotor speed has already reached its production value.

Another variant of the process described so far through FIGS. 3 and 4 will now be discussed through FIG. 5. In this example, the spinning rotor 100 is braked only after back-feeding $R_F$ of the yarn end 300 to the fiber collection surface 102 of the spinning rotor 100 (point in time $t_1''$), so that the piecing speed of the spinning rotor 100 is the same as its production speed. Thereby, the yarn end 300 is subjected to the full speed of the spinning rotor 100 during its back-feeding $R_F$, i.e., during the piecing, and, thus, reaches the fiber collection surface 102 very rapidly and comes very quickly into contact there with the fibers 31 of the fiber ring 32. The production and propagation of false twist into the point of fiber integration 320 is correspondingly good.

On the other hand, in order to keep the yarn tension as low as possible at the point in time when yarn draw-off begins, the rotational speed $n_R$ of the spinning rotor 100 is reduced very rapidly between the points in time $t_1''$ and $t_3$. As FIG. 2 shows, the yarn mass and the tension in the drawn-off yarn 30 increases between the points in time $t_3$ and $t_5$ as well as between points in time $t_5$ and $t_4$. In order to achieve, nevertheless, a constant yarn tension, the rotational speed $n_R$ of the spinning rotor is further reduced, however, in a manner that is adjusted to the yarn mass. Assuming that the yarn 30 has already its desired thickness or mass as of point in time $t_4$ due to appropriate coordination of the yarn feeding and the yarn draw-off, then the rotational speed $n_R$ of the spinning rotor 100 is accelerated considerably that the spinning rotor 100 may, again, run at 100% of its operating speed as of point in time $t_4$, i.e., when the segment 331 of the piecing joint 33 is drawn off. At that point in time the speed $V_A$ of yarn draw-off need not necessarily have yet reached its final speed if it is matched to the fiber feeding taking effect in the spinning rotor 100.

Figure 5:
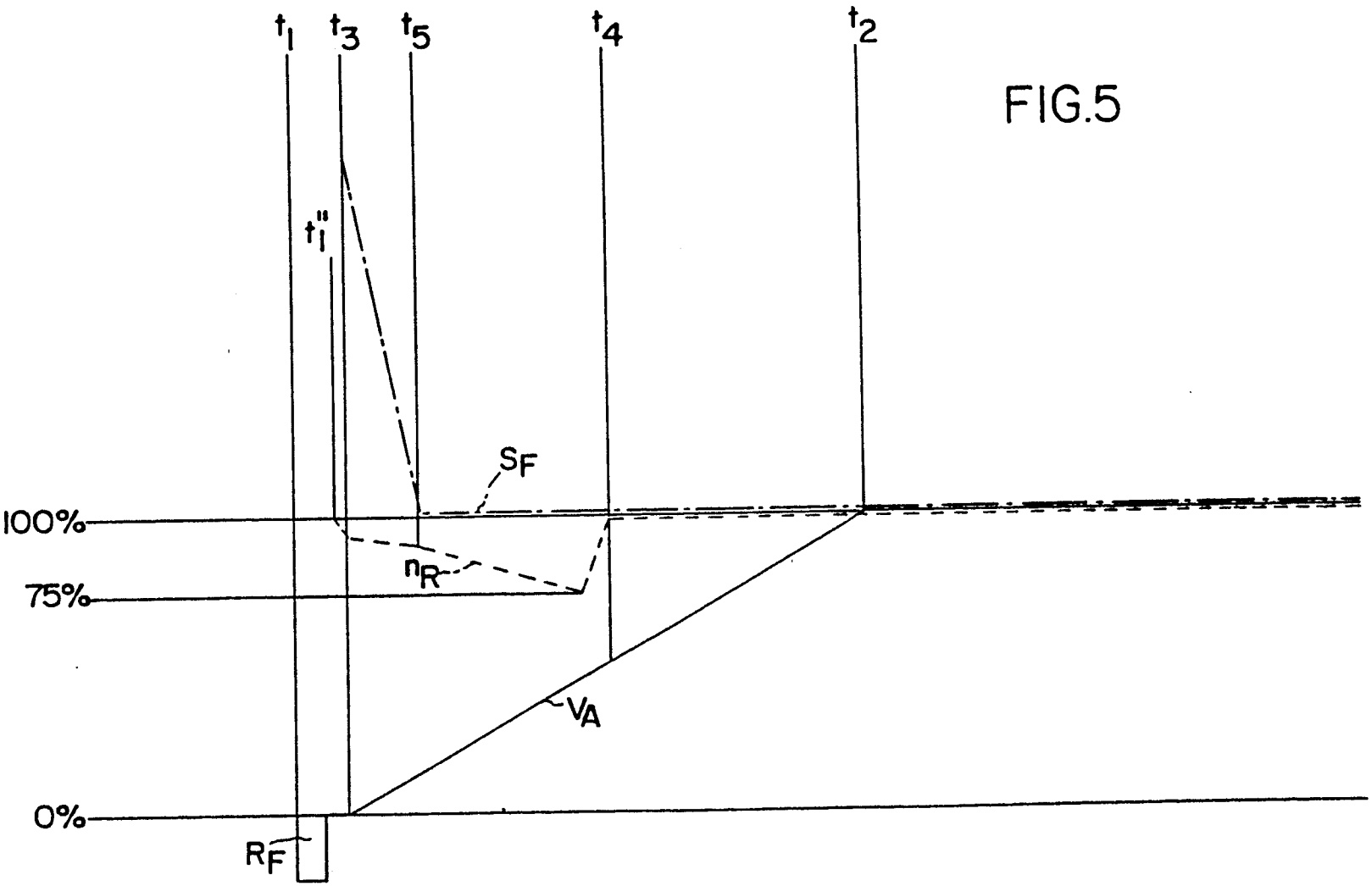

FIG. 5 shows clearly (ignoring the period of time before point in time $t_3$, i.e., before beginning of yarn draw-off) that the rotational speed $n_R$ of the spinning rotor 100 is reduced in two phases. The first phase, between points in time $t_3$ and $t_4$ is adjusted for good propagation of the twist (true and false) in the fiber ring 32 and also for a yarn tension that does not deviate excessively from the spinning tension, while the second phase serves solely to limit variations in the yarn tension.

Depending on whether it is more important that the tension $S_F$ be close to operating yarn tension, or whether it is more important that the twist in the drawn-off yarn 30 correspond to the operating conditions, the rotational speed $n_R$ of the 100 is reduced or increased, accordingly.

To show that through the described process illustrated in FIGS. 3 and 4, the tension peaks, as they occur unavoidably in the processes used until now, the tension $S_F'$ of the known processes is also drawn in on FIGS. 3 and 4 (for a rotor speed of 100%). It can be clearly seen that, contrary to the known processes, the tension tolerances are reduced in the new process by approximately one half.

The control of the reduction of the rotational speed $n_R$ of the spinning rotor 100 as a function of time was described above. It is, however, also possible to determine the lowest rotational speed at which, when reached, the reduction of rotational speed is ended and a change-over to rotational speed increase is effected. In that case, several of the times shown in FIGS. 3 to 5 are derived times.

According to FIGS. 3 to 5, provisions are made for the back-feeding of the yarn end to the fiber collection surface to take place, either at full production speed (100%) of the spinning rotor 100 (See FIGS. 3 and 5) or, on the other hand, when the reduction of the rotational speed $n_R$ of the spinning rotor 100 has already started.

Figure 14:
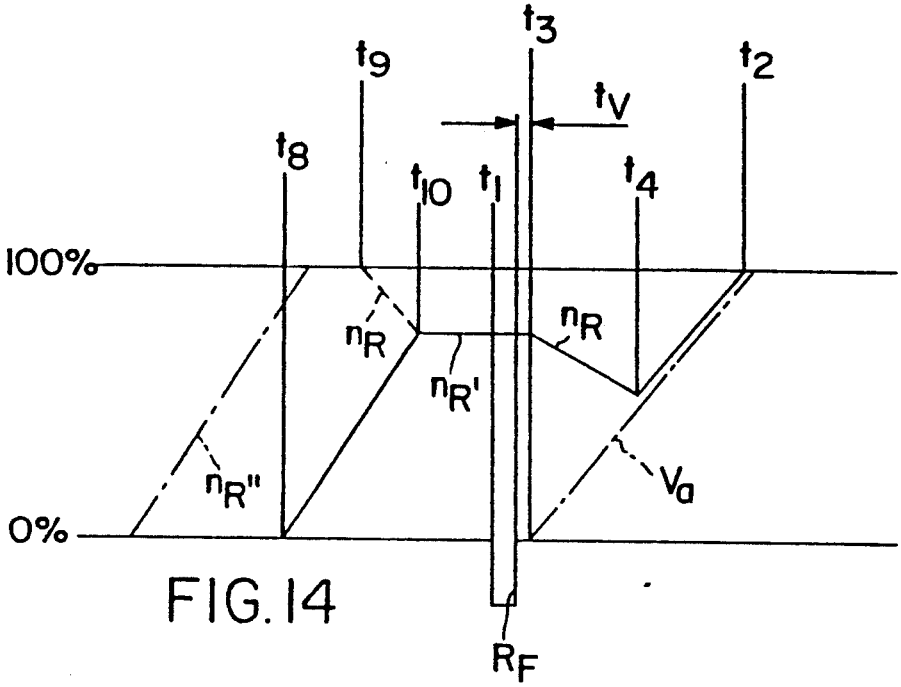
FIG. 14 shows schematically the rotor speed and the yarn draw-off speed in a variant of the process.

FIG. 14 shows another modification in which the rotational speed $n_R$ of the spinning rotor 100 is maintained constant (see rotational speed $n_R'$ during back-feeding $R_F$ of the yarn end 300 to the fiber collection surface 102 of the spinning rotor 100, i.e., from the point in time $t_{10}$ to the point in time $t_3$. This constant rotational speed $n_R'$ can be called up, in this case, selectively from the production speed (100%—see point in time $t_9$) or from a stop (0° —see point in time $t_8$.

Maintaining a constant rotational speed $N_R'$ of the spinning rotor 100 during back-feeding $R_F$ of the yarn end 300 has the advantage that the times can be determined precisely for the actual piecing (back-feeding of the yarn-end 300, switching on the fiber feeding, and the onset of new yarn draw-off) since no speed changes due to tolerances, etc. occur during that time. At the latest, starting with point in time $t_3$, i.e., from the moment when yarn draw-off begins (see speed $V_A$), the rotational speed of the spinning rotor 100 is reduced so that the tension $S_F$ of the piecing joint is kept essentially constant, or at least within tolerable limits.

On the other hand, the reduction of the rotational speed $n_R'$, which was maintained constant before the piecing, begins at the earliest at point in time $t_1$, that is, at the point in time when the back-feeding $R_F$ of the yarn end 300 begins. Reduction of the rotational speed $n_R'$ of the spinning rotor 100 can thus begin selectively, depending on the prevailing spinning conditions between the point in time $t_1$ of the back-feeding $R_F$ of the yarn end 300 and the point in time $t_3$ of the beginning of yarn draw-off.

For reasons of control it is advantageous to trigger the rotational speed $n_R'$ of the spinning rotor 100 from above for piecing, even when the spinning rotor 100 had stopped before piecing. Such a modification is shown in FIG. 14 by the line $n_R''$. The rotor speed here is first accelerated from a full stop to a speed (rotational speed $n_R'$) which is greater than the piecing speed, and is braked from that rotational speed to the piecing speed (rotational speed $n_R'$). The rotational speed at which the speed reduction begins is the production speed (100%) according to FIG. 14, but, if desired, a speed between the rotational speed $n_R'$ and the production speed (100%) can be selected. This manner of initiating the piecing speed is an advantage when the piecing speed is maintained constant on a temporary basis (according to FIG. 14), but also when the rotational speed is further lowered after attaining the piecing speed, without interruption of the speed reduction, when piecing is carried out during this speed reduction.

It was assumed, above, that fiber feeding into the spinning rotor 100 starts before the yarn end 300 reaches the fiber collection surface 102. However, this is not a precondition to carrying out the process. If the fiber feeding device 11 is already switched on but the fibers 31 are prevented from reaching the fiber collection surface 102 and are, instead, deflected first from the surface, then yarn end 300 can be back-fed onto the fiber collection surface 102 before the fiber flow is released to the fiber collection surface 102. In this manner, extremely precise control of the piecing process and the sizing of the piecing joint 33 is possible.

In order to implement the described process it is necessary to coordinate the rotational speed $n_R$ of the spinning rotor 100 with the piecing process, in particular with the back-feeding $R_F$ of the yarn end 300 to the fiber collection surface 102, and with the resumed draw-off of the yarn. For that purpose provisions are made, in the device shown in FIG. 10, for the control device 20 to be equipped with appropriate time control means. Since, in practice, different fiber materials are spun at different rotational speeds $n_R$ of the spinning rotor 100, the time control means 23, according to FIG. 10 is equipped with adjusting means 230 and 231 by means of which the "on" period and the "off" period of the speed reduction of the spinning rotor 100 can be adjusted. Depending on how precisely the change in rotational speed is to be controlled, additional adjusting means are, of course, possible, but are not shown in FIG. 10 for reasons of clarity. It goes without saying that several adjusting means are provided to set the different points in time $t_1$, $t_1'$ or $t_1''$, $t_5$, $t_4$, $t_7$, $t_2$ and/or $t_6$. Alternately, it is also possible to provide two adjusting means, the first of which serves to enter the different points in time in sequence, while the second adjusting means serves to determine the change in rotational speed, i.e., speed reduction or speed acceleration.

Figure 10:
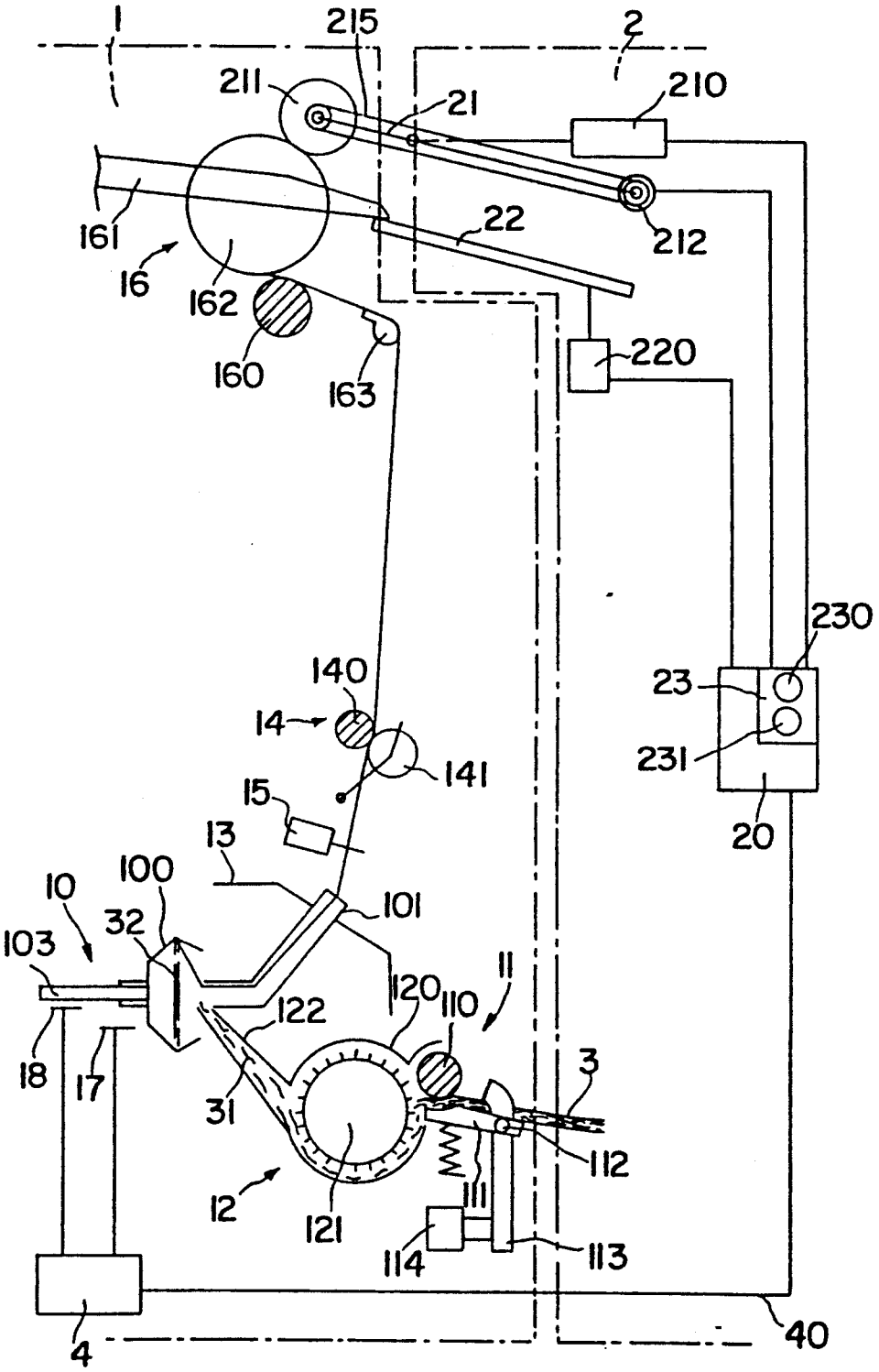
FIG. 10 shows a spinning station with an open-end spinning device according to the invention in cross-section.

In FIG. 10, a device, by means of which the rotational speed $n_R$ can be changed, is shown schematically. In this embodiment two drive belts 17 and 18 are provided which can be brought selectively into driving engagement with the shaft 103 of the spinning rotor 100 under the control of the control device 4. In order to coordinate the controls of the control devices 4 and 20, these are connected with each other through a circuit 40.

FIG. 12 shows a concrete embodiment of the device shown schematically in FIG. 10, for selectively driving the spinning rotor 100 by means of the main drive belt 17 or of the auxiliary drive belt 18. Drive belts 17 and 18 extend in the longitudinal direction of the open-end spinning machine 1 and are supported by support rollers 19 and 190 between the individual, adjacent open-end spinning devices lo. To control the drive of the spinning rotor 100, a change-over lever 506, mounted in a central position by means of the pivot bearing 54, is provided for supporting the control rollers 50 and 51, respectively on the ends of its arms 500 and 503.

In a neutral central full-line position, two control rollers 50 and 51 release the drive belts 17 and 18, which are lifted off from the shaft 103 of the corresponding spinning rotor 100 by means of the support rollers 19 and 190. The drives 52 and 53 are connected to the two arms of the change-over lever 506 for each open-end spinning device 10 through appropriate couplings and are, in turn, connected for control to the control device 4. When appropriate control signals emitted by the control device 4 actuate the driving device 52, the control roller 50 is pressed onto its assigned drive belt 17 so that belt 17 bears against the shaft 103 in its position 17'. Alternately, the belt 18 goes into its position 18' to bear against shaft 103 of the spinning rotor 100 when the control to that effect is exercised by the control device 4 to cause the driving device 53 to pivot the change-over lever 506 and to press the control roller 51 against the drive belt 18.

Drive belts 17 and 18 are driven at different speeds so that by switching the drive of the spinning rotor 100 to one or the other of the drive belts 17 or 18 causes the spinning rotor 100 to be driven at a different speeds.

By means of different lifting stroke paths, the change-over lever 506 can be pressed with a variable force with its roller 50 or 51 against the assigned drive belt 17 or 18, so that the latter also bears with variable force against the shaft 103 of the spinning rotor 100. Accordingly, controlled slippage between the drive belt 17 or 18, on the one hand, and the shaft 103 of the spinning rotor 100, on the other hand, varies, so that the rotational speed change (reduction or acceleration of the speed) also occurs with varying rapidity, in accordance with this controlled slippage.

The above description shows that it is necessary, in order to carry out the explained process, to provide means through which the rotational speed $n_R$ of the spinning rotor 100 is reduced to a lower value from the piecing speed, which could be identical with the production speed. These means comprise, in the above-described embodiment, the drive 53, the arm 503 of the change-over lever 506 and the control roller 51. Means must also be provided through which the spinning rotor 100 is accelerated. These means comprise, in the above-described embodiment of the drive 52, the arm 500 of the change-over lever 506 and the control roller 50. Means are also provided which cause the accelerating rotor speed to be tied to the yarn production speed. These means comprise the drive 52 and the change-over lever 506 as well as its arm 500 with the control roller 50, since appropriate pivoting of the change-over lever 506 produces slippage-free driving of the spinning rotor 100 by the drive belt 17.

The control of the rotational speed $n_R$ of the spinning rotor 100, by controlling the slippage can also be effected by means of such devices (with only minor design adaptations) when only one single drive belt 17 and only one single control roller 50 are provided, since the drive connection between the drive belt 17 and the shaft 103 of the spinning rotor 100 is decreased as the slippage increases, so that the spinning rotor 100 is decelerated to a lower rotational speed $n_R$ while the spinning rotor 100 is accelerated once more when the slippage decreases. The means for the reduction of rotor speed, for the resumed acceleration of the rotor speed and to tie the rotor speed to the production speed are created here by the change-over lever 506 (which has only one arm in this case).

Figure 15:
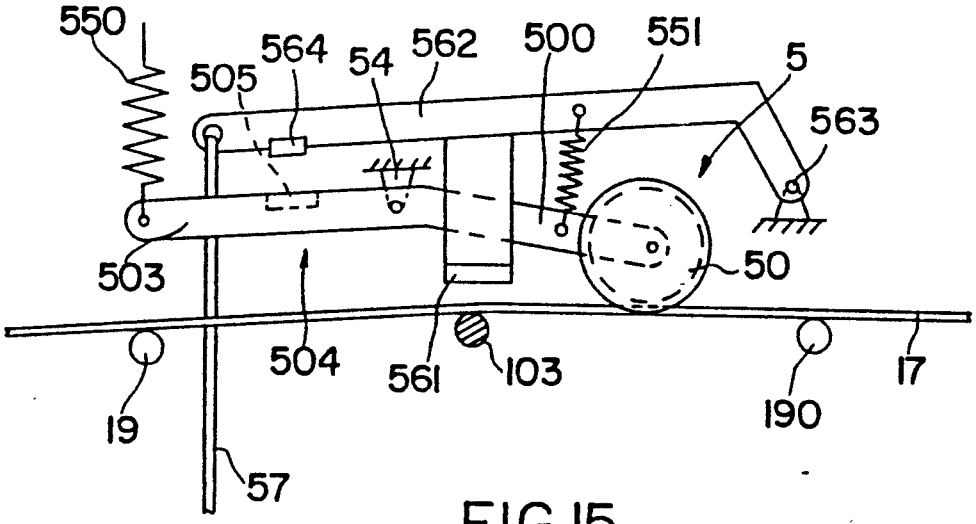
FIG. 15 shows a schematic side-view of a driving device of an open-end spinning device with a controllable belt application device.

An embodiment of this device is shown in FIG. 15. Instead of a change-over lever 506, a two-arm roller lever 504 is provided, which is equipped with a control roller 50 at the end of its one arm 503. At the other end of its arm 503, a tension spring 550 takes effect, the other end of which spring is anchored to a stationary point on the machine frame.

Furthermore, a braking lever 562 is provided which is pivotably mounted on a pivot axis 563, independently of the change-over lever 503. The braking lever 562 has a brake lining 561 which can be brought to bear against the shaft 103 of the spinning rotor 100. For the control of the braking lever 562 the latter is connected to the control rod system 57.

The braking lever 562 extends essentially at a parallel to the roller lever 503, with the pivot axle 563 being on the side on which the control roller 50 is also located in relation to the pivot bearing 54 of the roller lever 503, while the control rod system 57 is on the side of the change-over lever 504 with the arm 503. On the same side, in relation to the pivot bearing 54, the braking lever 562 bears a stop 564 which pivots the roller lever 504 against the action of the tension spring 550 when it runs up against a stop 505 on the arm 503 or against the arm 503 itself. Depending on the pivoting path of the braking lever 562, which is determined by the stroke movement of the control rod system 57, the control roller 50 is pressed with more or less force against the drive belt 17, so that the spinning rotor 100 is imparted variable acceleration as a result of the controlled variable slippage between drive belt 17 and shaft 103.

Even more precise control of the slippage, and, thereby, of the drive of the spinning rotor 100 by means of the drive belt 17 through the shaft 103 is obtained if the braking lever 562 and the arm 500 of the roller lever 504 are connected to each other by a tension spring 551. With such a design of the belt application device, the action of the tension spring 550 is greater than the action of the tension spring 551. This is achieved by varying the distances between the application points of the tension springs 550 and 551 and the pivot bearing 54 and/or through tension springs 550 and 551 of different strength.

If the braking lever 562, with its stop 564, is removed from the roller lever 504 or from the stop 505 which lever 504 supports, the tension spring 550 causes the control roller 50 to be applied against the drive belt 17 and to press it against the shaft 103 of the spinning rotor 100. The further the braking lever 562 is removed from the roller lever 504, the more the tension spring 551 whose force is opposed to that of the tension spring 550 is put under tension. Since the force of the tension spring 550 exceeds that of the tension spring 551, the control roller cannot be lifted off from the drive belt 17, but the tension spring 551 reduces the force of the tension spring 550 so that merely the differential force between the acting forces of the tension springs 550 and 551 takes effect in pressing roller 50 onto belt 17. In this manner a very precise slippage control between the drive belt 17 and the shaft 103 and, thereby, precise drive control of the spinning rotor 100 is possible, in that the braking lever 562 can be brought into different relative force positions with respect to the roller lever 504.

When the braking lever 562 is moved into its braking position, the stop 564 comes up against the roller lever 503 or against its stop 505 and in the continuation of its movement lifts the control roller 50 from the drive belt 17. Finally the brake lining 561 comes to bear against the shaft 103 and stops the spinning rotor 100.

It goes without saying, that with an appropriate arrangement and design, the tension springs 550 and 551 can be replaced by other springs such as compression springs or by appropriate hydraulic or pneumatic means. In that case it is also possible, depending on the arrangement of these resilient means, to use a one-arm roller lever (not shown) instead of a two-arm roller lever 504.

Figure 16:
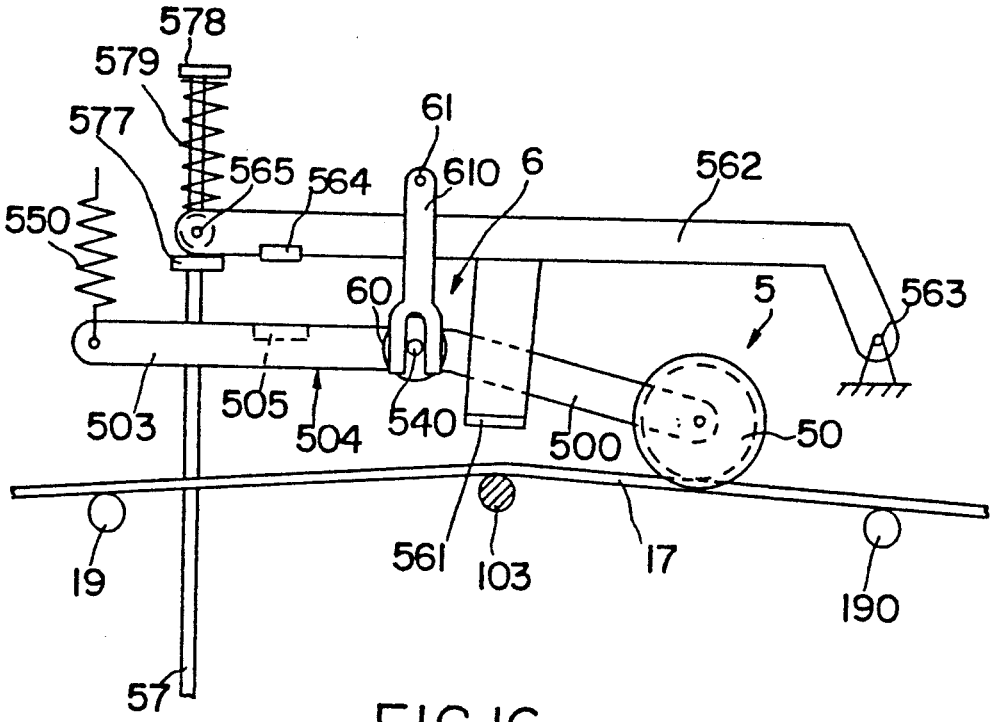
FIG. 16 shows a schematic side view of a driving device of an open-end spinning device with a variant of a controllable belt application device and a controllable braking device.

In another embodiment of the driving device (as seen in FIG. 16), a controllable dampening device 6 is provided for the roller lever 504 between the braking lever 562 and that roller lever 504 instead of a tension spring 551 or some other resilient coupling link to decrease the slippage.

In principle, the dampening device 6 can be designed in different ways. According to FIG. 16, a Belleville spring washer 60 is installed on the pivot axle 540 by means of which the roller lever 504 (or possible the change-over lever 506—see FIGS. 8 and 12) is mounted in an axially immobile manner on the pivot bearing 54. A rod 61, capable of moving at a parallel to the pivot axle 540 and bearing a fork 610 is provided. The fork 610 reaches around the pivot axle 540 which comprises a bolt and exerts a pressure on the Belleville spring washer 60 which bears against the roller lever 504 (or against the change-over lever 506), said pressure depending on said fork's position in relation to the roller lever 504 (or to the change-over lever 506). The greater the pressure, the greater the pre-stress of the Belleville spring washer 60 and the greater, therefore, also the dampening action of the dampening device 6.

The function of the dampening device 6 shall be described below. In principle, such a dampening device 6 has the task of rendering the roller lever 504 or the change-over lever 506 sluggish in order to prevent a minor imbalance in the spinning rotor 100 from leading to increased wear of the roller lever 504 or of the change-over lever 506, and of its bearing. On the other hand, a dampening device 6, when it is controllable, offers the possibility of controlling the acceleration of the spinning rotor 100. When the roller lever 504 or the change-over lever 506 is released by the braking lever 562, it follows the force exerted by the tension spring 550 (or by some other suitable resilient element) as a function of the pre-stress of the Belleville spring washer 60, only with some delay. The stronger the pre-stress of the Belleville spring washer 60, the more time it takes until the roller lever 504 or the change-over lever 506 brings the control roller 50 into full contact with the drive belt 17. Thus, it is possible, by moving the fork 610 parallel to the pivot axle 540 of the roller lever 504 or of the change-over lever 506 to control the response time with which the roller lever 504 or the change-over lever 506 reacts to being released by the braking lever 562.

The weighing element which is made in form of a fork 610 in the described embodiment can however be of different types. Thus, it is possible to pre-stress the Belleville spring washer 60 by means of a stepping motor (not shown).

The dampening element 6 can also be made in different ways, e.g., in the form of the controlled bypass circuit (not shown), in the form of a hydraulic or pneumatic piston, whereby dampening depends on the degree to which the bypass circuit is open.

A similar design, whereby the rotational speed $N_R$ of the spinning rotor 100 is controlled by means of a change-over lever 506 is explained below with reference to FIG. 8. The change-over lever 506 is mounted in a central position on a pivot bearing 54. The arm 500 supporting the control roller 50 is provided with a compression spring 55 which bears, in a suitable manner, against the frame 191 of the open-end spinning machine 1. The compression spring 55 thus causes the control roller 50 to hold the drive belt 17 in contact against the shaft 103 of the spinning rotor 100 when regulation is to be effected.

The arm 500 of the change-over lever 506 is provided with a stop 501 against which a stop 560 of a braking lever 56 can be brought to bear. The braking lever 56 is installed, together with the control roller 50, on a common axle 502. At its free end the braking lever 56 is connected to a control rod system 57.

The braking lever 56 is equipped with a brake with a brake lining 561 between its two ends which is lifted off the shaft 103 of the spinning rotor 100 in the position shown. If the control rod system 57 of FIG. 8 is pulled downward, the brake lining 561 is brought to bear against the shaft 103 so that the spinning rotor 100 is braked. Furthermore, when the movement of the control rod system 57 continues, the control roller 50 is lifted off the drive belt 127 so that said drive belt 17 is lifted off from the shaft 103 of the spinning rotor 100 by the support rollers 19 and 190 (see FIG. 12). When the control rod system 57 returns into the position shown, the compression spring 55 returns the control roller 50 again to the position in which the drive belt 17 is brought to bear against the shaft 103 of the spinning rotor 100. If the control rod system 57 is lifted slightly, the stop 560 of the braking lever 56 first comes to bear against the stop 501 of the change-over lever 506. As this lifting movement of the control rod system 57 continues slightly, the contact pressure between the control roller 50 and the drive belt 17, and thereby also between said drive belt 17 and the shaft 103 of the spinning rotor 100, is decreased so that slippage increases. When the lifting action of the control rod system 57 continues, the braking lever 56 pivots the change-over lever 506 further by means of its stop 560, so that the control roller 51 brings the drive belt 18 to bear against the shaft 103 of the spinning rotor 100.

The determining factor is the extent of the lifting movement of the control rod system 57 in order to achieve a precisely defined slippage between the drive belt 17, which continues to be driven at unchanged speed and the shaft 103 of the spinning rotor 100 or between the drive belt 18, which also continues to be driven as before at the same speed, and the shaft 103 of the spinning rotor 100. Precise control of the speed of the spinning rotor 100 can thus be achieved through an appropriate lifting stroke of the control rod system 57. Appropriate control of the slippage between the drive belt 17 driven at higher speed and the shaft 103 controls the acceleration of the spinning rotor 100, while control of the slippage between the drive belt 18, driven at lower speed, and the shaft 103 of the spinning rotor 100 controls the speed reduction.

Figure 8:
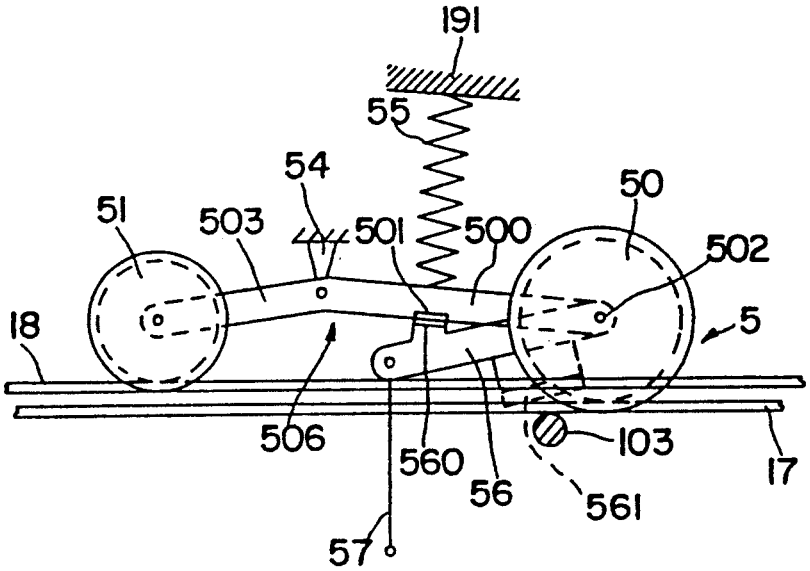
FIGS. 8 and 9 show the driving device for an open-end spinning device with a belt application device made in accordance with the invention, in schematic views.
Figure 9:
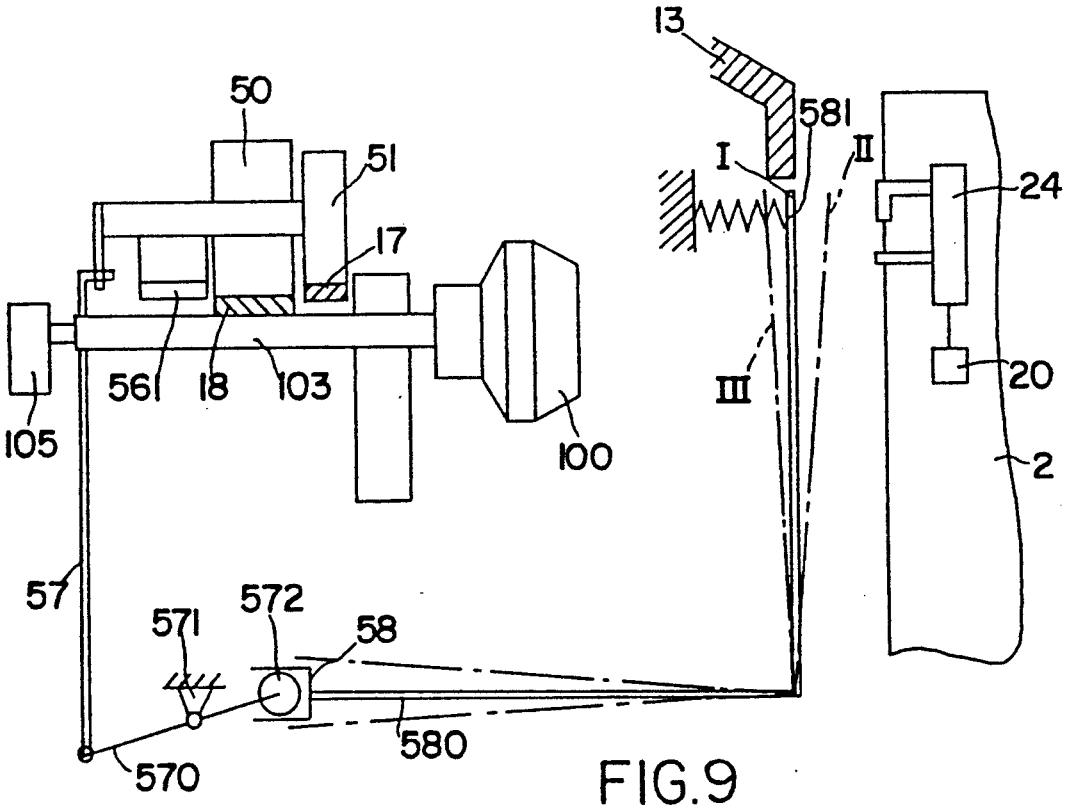

FIG. 9 shows the device of FIG. 8 for the control of the spinning rotor 100 in a side view. The spinning rotor 100 is mounted by means of supporting disks 104, of which only one is shown in FIG. 9, and by means of an axial/radial bearing 105. The control rod system 57 is provided with a two-arm lever 570 which is capable of being pivoted around a bearing 571. On its free end the lever is equipped with a roller 572 which is surrounded by a fork 58. The fork 58 is on the end of a knee lever 580, the free end 581 of which is mounted in a slit in the cover 13. In addition to its full-line position I, which represents the spinning position, the free end can also assume a position II in which the brake lining 561 (FIG. 8) is brought to bear against the shaft 103 of the spinning rotor 100. Furthermore, the free end of the knee lever 580 can also assume a position III in which the roller 51 pushes the drive belt 18 against the shaft 103 of the spinning rotor 100. The lever movement is controlled by means of a driving device 24 capable of being assigned to the knee lever 580. Driving device 24 is installed on the service unit 2 and is controlled by the control device 20.

FIG. 9 shows that by shifting to the position III the depth of depression of the control roller 50 or 51 in relation to the drive belt 17 or 18 can be changed. To be able to set a precise lifting stroke in relation to the knee lever 580, the driving device 24 can be provided with an adjustable stop (not shown) on the cover 13 against which a counter-stop bears in its adjusting movement. The counterstop is connected to the driving device 24 or to an actuating element of it.

Such an adjustable stop need not interact with the driving device 24 but may be assigned at will (depending on the configuration of the belt application device)

to the change-over lever 506 (see the adjustable stops of FIG. 12 serving as adjusting device 59, 590), to its control rod system 57 or to the knee lever 580. Depending on the design of the belt application device the stop (not shown) can also determine either the maximum or the minimum contact pressure. The adjustment may be manual or, in adaptation to different desired rotor speeds, changes can be automatic as shall be described later in greater detail.

The change-over lever 506 with its control element constitutes a belt application device 5 by means of which the contact pressure between drive belts 17 or 18 and the shaft 103 of the spinning rotor 100 can be controlled, as desired, in order to control the rotational speed $n_R$ of the spinning rotor 100. With a two-armed change-over lever 506, both or only one of the arms 500 and 503 are brought into action as part of the belt application device.

If very rapid reduction of the rotor speed is required, a reduction of the rotational speed $N_R$ by means of the drive belt 18 may be too slow. According to the embodiment shown in FIG. 13, (a variation of the embodiment described earlier through FIGS. 8 and 9 of the device for the control of the rotational speed $n_R$ of the spinning rotor 100), separate control rod systems 573 and 574 are provided for the change-over lever 506 and for the braking lever 56 so that the braking action of the brake may be controlled precisely. This is done in the device shown in FIG. 13 similarly to the control of the belt application device. For that purpose the control rod system 573 connects the arm 503 of the change-over lever 506 bearing the control roller 51 to the lever 570 which was described earlier through FIG. 9. The control rod system 574 is connected to a knee lever 575 which is mounted pivotably by means of a bearing 576. The knee lever 575 is located in a slot next to the knee lever 580 in the cover 13. For the sake of clarity, the arrangement of the change-over lever 506 and of the directly or indirectly assigned elements is shown with a 90° rotation in FIG. 13. Neither is the knee lever 575 built in as shown three-dimensionally.

Figure 13:
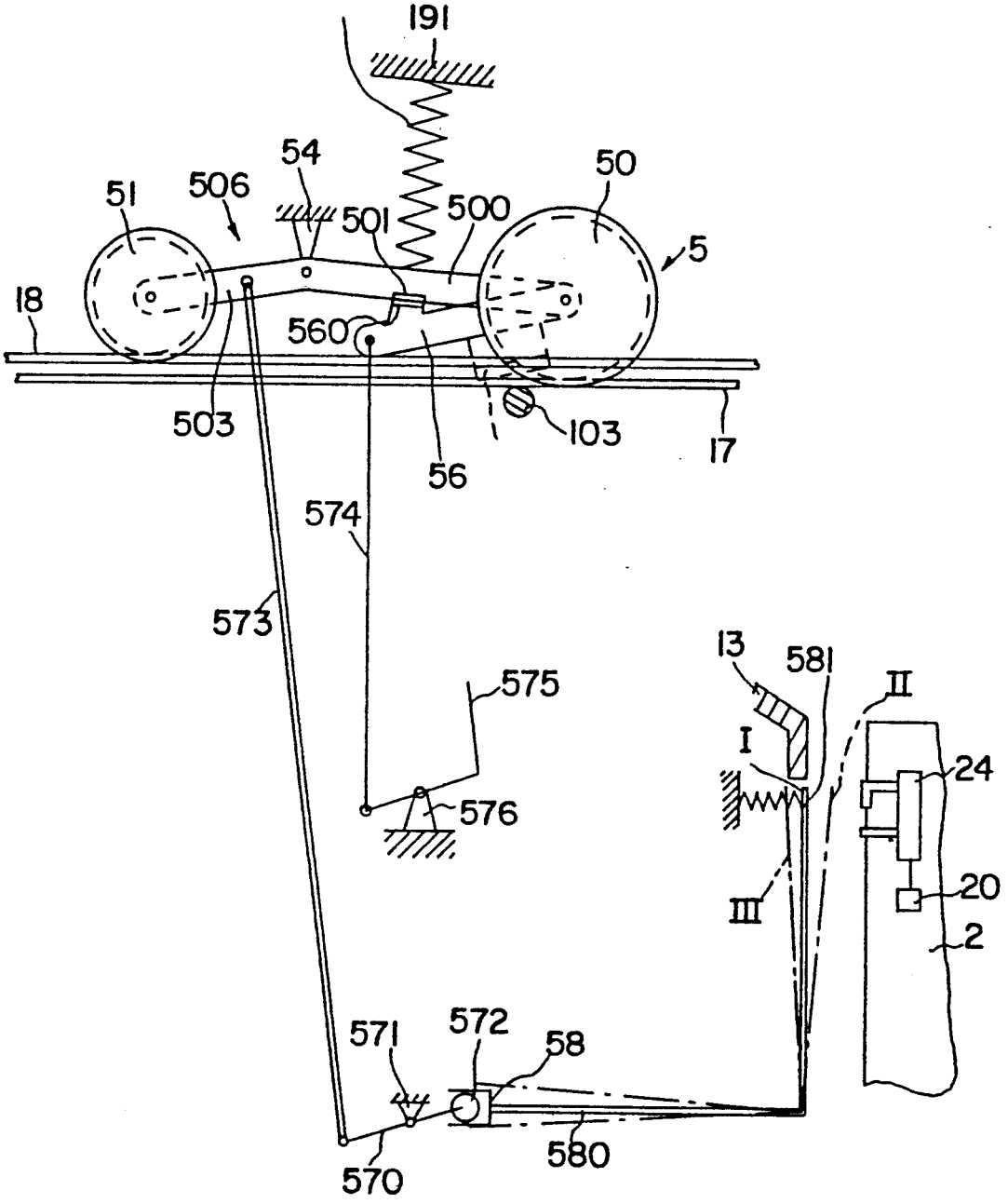
FIG. 13 shows an open-end spinning device according to the invention which is equipped with a controlled rotor brake for the control of the rotor speed.

The action of the brake shown in FIG. 13 can cause the reduction of the rotational speed $N_R$ of the spinning rotor 100, with the simultaneous reduction of the rotational speed $n_R$ of the spinning rotor 100 through control of the slippage between the drive belt 17 or 18 and the shaft 103. Great reduction of rotational speed, especially in the first phase of a multi-phase speed reduction is advantageous here.

A further variation of device, by means of which the braking action is controlled precisely, shall now be explained through an embodiment of the device shown in FIG. 16. This device has already been discussed as far as the dampening device 6 is concerned.

In the embodiment of the device according t FIG. 16, in which the control rod system 57 is connected directly to the braking lever 562, the brake lever 562 is provided with a guide 565 through which a bolt of the control rod system 57 is led. On the side towards the roller lever 504 or the change-over lever 506, this bolt of the control rod system 57 is provided with an axially unmovable stop 577 in order to necessarily provide slaving of the braking lever 562 with a movement away from the roller lever 504 or from the change-over lever 506, in the lifting direction. On the side away from the roller lever 504 or from the change-over lever 506 the bolt of the control rod system 57 is also provided with a stop 578 which is placed at a distance from the guide 565. A compression spring 579 is provided between guide 565 and stop 578.

If the control rod system 57 is actuated in such manner that the braking lever 562 with its brake lining 561 comes to bear against the shaft 103 of the spinning rotor 100, i.e., if the brake lever 562 is moved in the direction of the brake, it is slaved only through the compression spring 579 which is first relaxed or only slightly prestressed. When the brake lining 561 comes to bear against the shaft 103, the brake takes effect with only very little force since the further stroke of the control rod system 57 is taken up by the compression spring 579. Thereby, the pre-stress of this compression spring 579 rises, so that the resulting braking force also increases accordingly in time. By selecting the stroke accordingly, the brake action and with it also the braking effect on the spinning rotor 100 can be controlled.

If the control rod system 57 is actuated in opposite direction in order to move the braking lever 562 in the lift-off direction, the braking force is first reduced without moving the braking lever 562 until the compression spring 579 has again reached its relaxed starting position. At that moment the stop 577 comes to bear against the guide 565 and from there on slaves the braking lever 562 so that the brake lining 561 is lifted off from the shaft 103.

The described device can also be combined with a dampening device 6 (according to FIG. 16) or with a tension spring 551 (as seen in FIG. 15) between roller lever 504 or change-over lever 5 on the one hand and braking lever 562 on the other hand, so that the braking as well as the run-up condition of the spinning rotor 100 can be controlled precisely.

If the braking lever 562 in such a device, combined with a dampening device 6, is moved further in the lift-off direction, once the shaft 103 has been released by the brake lining 561, the roller lever 504 or the change-over lever 506 follows this movement with some delay, depending on the pre-stress of the dampening device 6, so that the contact pressure between drive belt 17 and shaft 103 caused by the control roller 50 increases gradually. This is also the case if a tension spring 551 or similar device is used instead of a dampening device 6, whereby the contact pressure depends on the relative position of the braking lever 562 in relation to the roller lever 504 or the change-over lever 506.

The described process, and also the described device, can be modified in many ways within the framework of the instant invention, for example by replacing individual elements with equivalents or through different combinations. The control of the piecing process, and, thereby, also of the times to be observed for this, of rotational speed decelerations and accelerations as well as also of the acceleration of the yarn draw-off can be carried out in different manners, e.g., by determining or adjusting the desired times. However, it is possible that, due to different factors such as manufacturing tolerances, tolerances due to wear, variable slippage, etc., certain deviations may occur in the operation of the driven elements. To reduce these to a minimum, the rotor speed can be controlled as a function of the yarn draw-off speed. In this case it is advantageous for the rotor speed to be reduced to the same percentage value of the yarn draw-off speed (speed $V_A$), and to be accelerated again, thereafter, in synchronization with the yarn draw-off speed in order to obtain constant twist which would be the same as that obtained under normal spinning conditions. For this purpose, provisions are made according to FIG. 11 for the speed $V_A$ of the device, at which the yarn 30 is drawn off from the open-end spinning device 10 after piecing, to be monitored.

By means of this mentioned device it is possible to monitor the draw-off speed of the yarn 30.

For this purpose the control device 4, as a rule with intercalation of the control device 20 on the service unit 2, (see FIG. 10) is connected to the drive motor 212 of the auxiliary drive roll 211.

Figure 11:
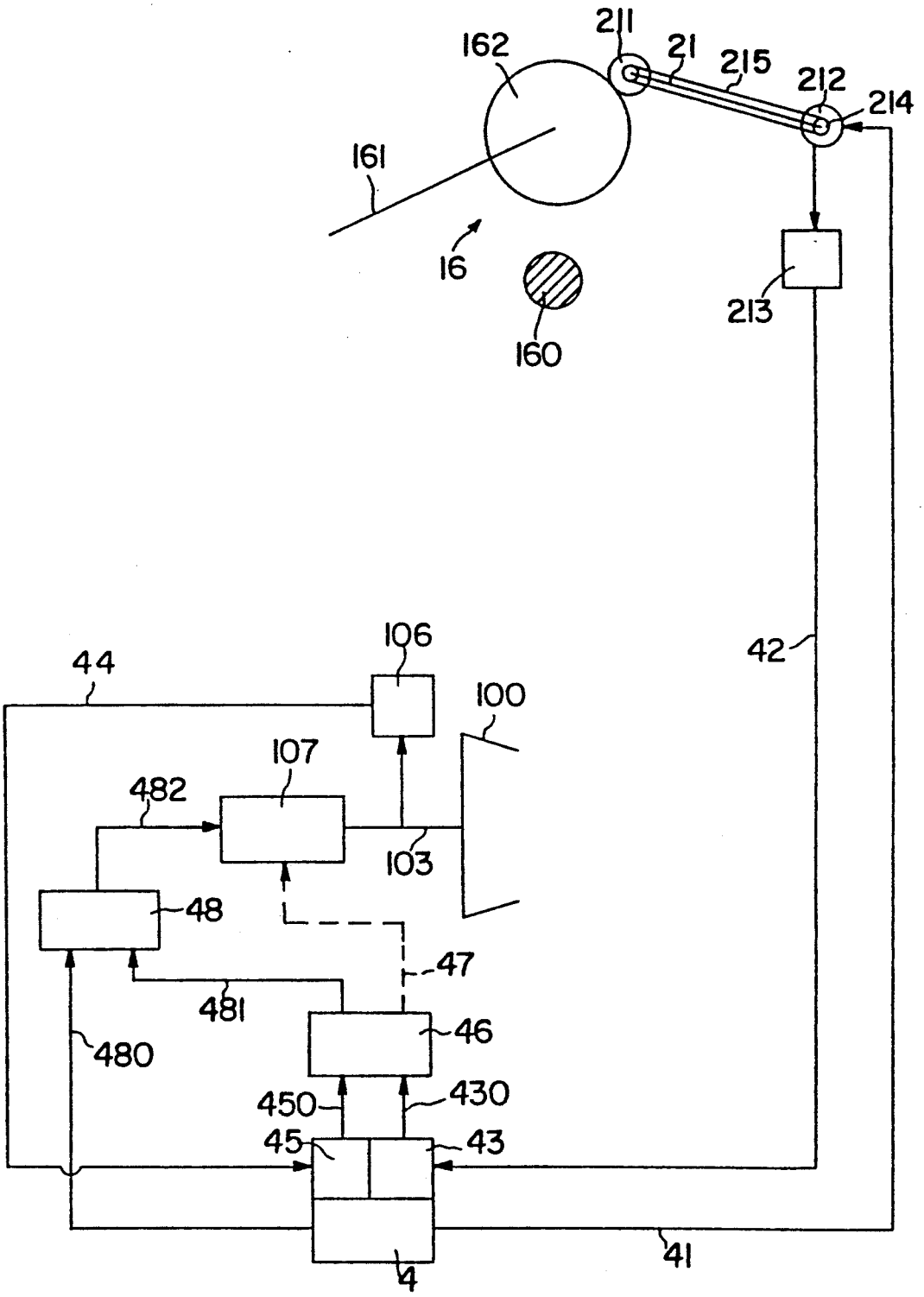
FIG. 11 shows schematically the control connections between the yarn draw-off and the rotor drive.

FIG. 11 shows such a device which is controlled directly, without the intermediary of a service unit 2, as may be the case in certain testing devices for example.

According to FIG. 11, the control device is connected via a circuit 41 to the drive motor 212 in order to give it the required control impulses for start-up and acceleration. The speed of the drive motor 212 is scanned by a tachometer 213 which may scan the extended axle of the drive motor 212 for instance. A drive wheel or pulley 214 is on that axle and is connected via a chain or a belt 215 to an additional drive wheel on the axle of which the auxiliary drive roll 211 is installed.

The tachometer 213 is connected through a circuit 42 to a means 43 of the control device 4 which compares the electrical magnitude produced by means of the tachometer with the magnitude the auxiliary drive roll 211 would attain after reaching its desired rotational speed, and from this derives the appropriate percentage value of the value detected by the tachometer 213.

The shaft 103 of the spinning rotor 100 is similarly assigned a tachometer 106 which is connected through a circuit 44 to a means 45 of the control device 4 and calculates, in the same manner as the means 43, through comparison of the actual rotational speed with the desired rotational speed, the percentage value of the present rotational speed $n_R$ of the spinning rotor 100. The measured values of the yarn draw-off speed and of the rotor speed, converted into percentages by the two means 43 and 45 for the conversion of the measured values into percentage values, are transmitted through circuits 430 and 450 to comparison means 46 where they are checked to see whether the two percentage values coincide. The comparison means are connected by a circuit 481 to the input of a comparison device 48, the other input of which is connected by a circuit 480 to the control device 4.

In the embodiment shown in FIG. 11, the drive of the spinning rotor 100 is made in form of a motor 107 for independent drive, which is connected to the comparison device 48 by a circuit 482.

The control device 4 transmits control impulses during the piecing by the circuit 41 to the drive motor 212, which then drives the bobbin 162, accordingly, by the auxiliary drive roll 211 and draws off the yarn 30 from the spinning rotor 100 by means of bobbin 162. The pair of draw-off rolls 14 (see FIG. 10) is opened thereby, so that the piecing draw-off alone is effected solely by the bobbin 162. During the run-up of the drive motor 212 the tachometer 213 supplies corresponding impulses by circuit 42 to the means 43 of the control device 4 which converts the measured values obtained by the tachometer 213 into percentages. The preadjusted, full yarn draw-off speed serves as a reference value.

At a predetermined point in time, possibly even before the back-feeding $R_F$ of the yarn end 300 into the spinning rotor 100, the reduction of the rotational speed $n_R$ of the spinning rotor 100 is begun. Then, for as long as the spinning rotor 100 has not reached the same percentage value as the yarn draw-off, the transmission of a control impulse by a circuit 482 to the drive of the spinning rotor 100, e.g., to a motor for independent drive 107, is prevented by the control device 4 by the comparison device 48. When the rotational speed $n_R$ of the spinning rotor 100 reaches the same percentage value as the speed $V_A$ of yarn draw-off, however, the comparison means 46 transmits a corresponding impulse via circuit 481 to the means 48. This causes the speed reduction, initiated earlier via circuit 480, to be ended by the transmission of an appropriate control impulse by circuit 482 to the single-drive motor 107. Acceleration now proceeds in the manner indicated by the control device 4.

When the yarn draw-off has reached the desired production speed the yarn 30 is brought under the lifted draw-off roll 141 and draw-off roll 141 is then lowered in a known manner onto the driven draw-off roll 140, or the yarn 30 is inserted in another manner into the pair of draw-off rolls 14, so that draw off is then carried out by this pair of draw-off rolls 14. The auxiliary drive roll 211 is then lifted from the bobbin 162 which is now brought to bear against the driven winding roll 160.

The process of piecing draw-off described above is imparted to the yarn 30 at a greater distance than after reaching production-draw-off speed by means of a bobbin 162 instead of by means of the pair of draw-off rolls 14 (as is perfectly possible) offers the advantage that the true twist is distributed over a greater yarn length in the piecing phase. Thereby, the advantage of a high degree of false twist can be utilized during the draw-off of the length segment 330 on the one hand, without excessive twist in the yarn 30 reaching the bobbin 162.

The monitoring of the speeds or rotational speeds can be direct or indirect. Thus, in the embodiment described above, the yarn draw-off speed is monitored indirectly by the rotational speed of the drive motor 212 and the rotational speed $n_R$ of the spinning rotor 100 is monitored directly.

The described device for scanning of the rotor speed (tachometer 106) can also be used when the changeover from speed reduction to speed acceleration is to be carried out as a function of the attainment of a previously determined minimum value of the rotational speed $n_R$ of the spinning rotor 100, without it being necessary to provide coordination with the acceleration of the speed $V_A$ of yarn draw-off for this.

In the case of the independent motor drive 107, the means for the reduction of the rotational speed $n_R$ of the spinning rotor 100 can be constituted by the control device 20 which could, for example, initiate and control the reduction of the rotational speed. The means for resumed acceleration can be constituted jointly by the control devices 4 and 20, in that the control device 20 initiates rotor acceleration which is then controlled by the control device 4 upon response to the tachometer 106. The means for tying the rotor speed to the production speed is constituted by the control device 4 alone which prevents further acceleration when the previously determined operating or production speed has been reached.

Alternately, it is also possible, when the acceleration of the spinning rotor 100 following the speed reduction is to be adapted to the acceleration of yarn draw-off speed, to provide for control impulses to be transmitted upon completion of the rotor speed reduction by circuit 47 to independent drive motor 107, adapting the acceleration of the spinning rotor 100 to the acceleration of the yarn draw-off, i.e., regulating it so that this acceleration evolves proportionally with the acceleration of the yarn draw-off, i.e., in such manner that the rotor acceleration (expressed in percentages) coincides with the acceleration of the speed $V_A$ of the yarn draw-off.

In the last-described process, the yarn draw-off speed is monitored during the entire time of its acceleration. The rotor speed change begins at the point in time when the rotational speed $n_R$ of the spinning rotor 100 has reached the same percentage share of the operating speed as that of the yarn draw-off and lasts until the point in time when the rotor speed and the yarn draw-off (together) reach full production values, in synchronization with the increase of yarn draw-off speed $V_A$.

To control the rotor acceleration it is also possible to provide the control device 4 with a generator (not shown) which produces suitable electrical values for the control of the rotor acceleration values which can be coordinated with the yarn acceleration, if desired.

In the variation of the process described so far, it was assumed that the yarn draw-off is accelerated along a set curve. This curve can be preset on the control device 20 of the service unit 2 or (if no service unit 2 is provided) on the control device 4.

However, it is also possible to let this setting proceed automatically. To explain this clearly, a description is given below of what occurs when the fiber sliver 3 is stopped through actuation of electromagnet 114 while the opening roll 121 continues to be driven. FIGS. 6*a* to 6*c* show the nip K in which the fiber sliver 3 is clampingly held when the fiber feeding device 11 is stopped. In the device shown in FIG. 10, the feeding roll 110 is not controlled for the stopping of the fiber sliver 3. Instead, a pivoting motion of the clamping lever 113 brings its upper end to bear against the feeding tray 111, whereby the fiber sliver 3 is clamped between the clamping lever 113 and the feeding tray 111, and feeding tray 111 is pivoted away from the feeding roll 110. The nip K is constituted by the line along which the clamping lever 113 presses the fiber sliver 3 against the feeding tray 111.

Alternately, the solenoid 114 and the clamping lever 113 can be omitted, and instead the feeding roll 110 can be provided with a coupling (not shown). In that case the nip K is constituted by the line in which the feeding tray 111 presses the fiber sliver 3 against the feeding roll 110.

FIGS. 6*a* to 6*c* also indicate a line A symbolizing the limit of the operating range of the opening roll 121 (see FIG. 10).

During the normal spinning process, when the fiber feeding device 11 and the opening roll 121 are running, the latter (from the right side, in FIGS. 6*a* to 6*c*) takes effect up to line A upon the forward end of the fiber sliver 3, the so-called fiber tuft 34, and combs fibers 31 out of it, to be then fed through the fiber feeding channel 122 to the spinning rotor 100. As shown in FIG. 6*a*, the fibers 31 extend far beyond the line A and into the operating range of the opening roll 121, while other fibers 31 reach only into the area between the nip K and the line A.

The fiber tuft 34 is of similar aspect during a brief stoppage of the fiber feeding device 11.

During longer stoppage periods of the fiber feeding device 11 while the opening roll 121 continues to run, the latter continues to comb fibers 31 out of the fiber tuft 34. The fiber tuft then contains only few fibers 31 extending beyond the line A (FIG. 6*b*). The longer the stoppage time of the fiber feeding device 11 (always with the opening roll 121 continuing to run), the shorter the fiber tuft 34 will be, until no more fibers 31 extend into the operating range of the opening roll 121. With long stoppage times, i.e., until the longest fibers 31 reach, at the most, from the nip K to the line A (FIG. 6*a*).

Figure 7A:
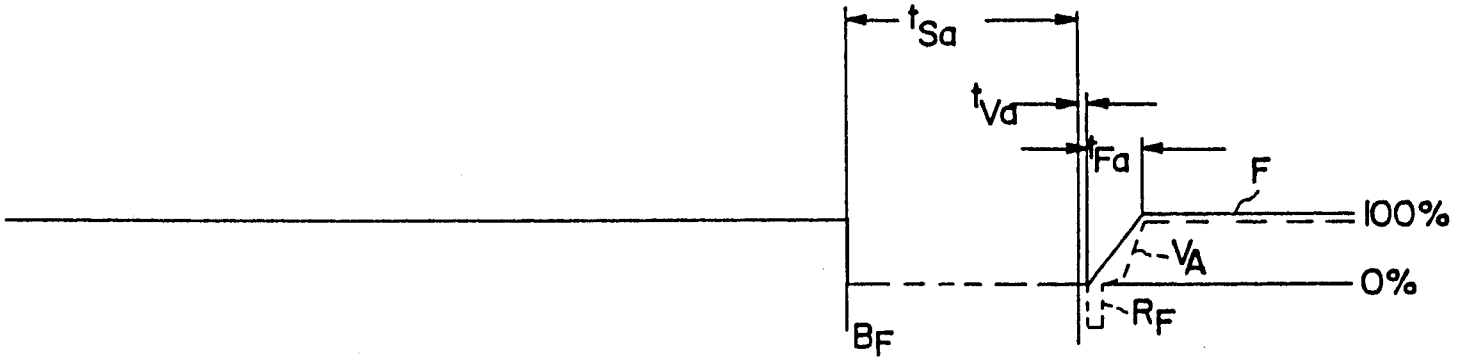
FIG. 7 shows a schematic comparison of the influence of different stoppage times of the fiber sliver upon the beginning of fiber feeding as well as the fiber draw-off speed adapted thereto.
Figure 7B:
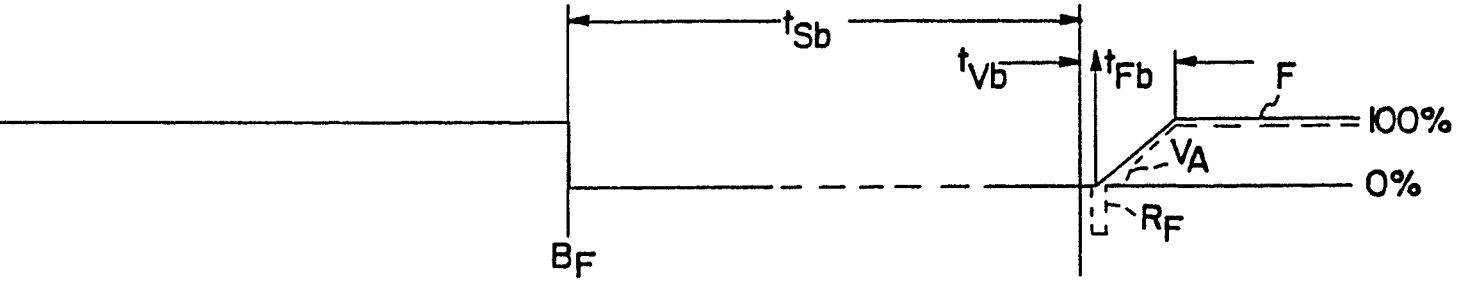
Figure 7C:
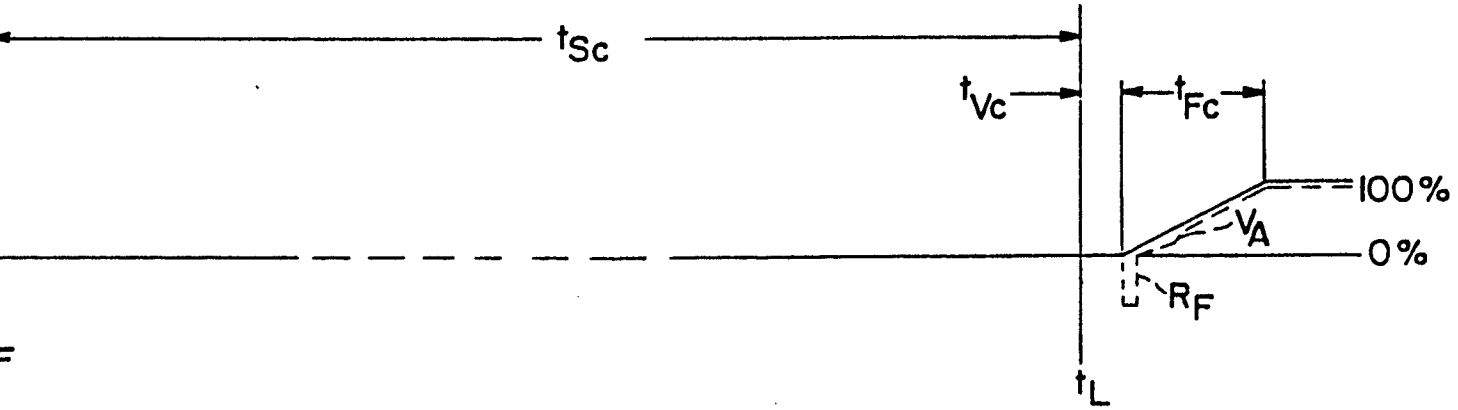

As shall now be explained in further detail through FIG. 7, the different states of the fiber tuft 34 result in a correspondingly different acceleration of feeding. FIG. 7 shows time t on the abscissa while the ordinate represents the speed in percentages. In FIGS. 7*a* to 7*c*, the different stoppage times $t_{sa}$, $t_{sb}$, $t_{sc}$, which begin with the occurrence of a yarn breakage $B_F$ and are ended by the switching-on of the fiber feeding device 11, again are shown.

When the fiber feeding device 11 is put back into operation at the point in time $t_L$ (FIG. 7) after a stoppage time, the fiber sliver 3 is again fed to the opening roll 121. With a very short stoppage time $t_{sa}$ (FIG. 7*a*) of the fiber feeding device 11 (compare with FIG. 6*a*), the fiber tuft 34 still has practically the same shape as during the spinning process itself. With a minor delay $t_{Va}$, determined by the time necessary to produce once more a fiber stream between the fiber feeding device 11 and the spinning rotor 100, fiber feeding, i.e., the fiber stream arriving on the fiber collection surface 102 of the spinning rotor 100 reaches again its full value (100% —see acceleration time $t_{Va}$). This is shown in FIG. 7*a*, where the fiber feeding F is represented by a thick, solid line.

If the stoppage time $t_{Sb}$ was somewhat longer (FIG. 7*b*), a thinned-out fiber tuft 34 is first within range of the opening roll 121. Thus, a somewhat thin fiber stream reaches the fiber collection surface 102 at first, after release of the fiber feeding device 11, and it also starts with a somewhat greater delay $t_{Vb}$ than the fiber flow according to FIG. 7*a*. Even if more and more fibers 31 come within range of the opening roll 121 with the subsequent movement of the fiber sliver 3, the fiber feeding still does not increase suddenly to its full value (100%), but requires some time for this. The acceleration time $t_{Sb}$ for a fiber tuft 34 according to FIG. 6*b* is thereby longer than for a fiber tuft 34 according to FIG. 6*a*.

The situation becomes even more extreme with a fiber tuft 34 which has been subjected to the effect of the opening roll 121 for a very long time, while the fiber feeding device 11 is stopped. In case of a very long stoppage time $t_{Sc}$ the fiber tuft 34 must first be brought beyond line A into the work or action zone of the opening roll 121. Since the fiber tuft 34 according to FIG. 6*c* was combed out considerably more than the fiber tuft 34 according to FIG. 6*b*, it also takes longer until the fiber flow begins (see delay $t_{Vc}$). The run-up time $t_{Sc}$ is also considerably longer.

As clearly appears from FIG. 7, the yarn draw-off (see speed $V_A$) must also be adapted to the effective fiber feeding F. From this, it follows that the control of the rotational speed $n_R$ of the spinning rotor 100 must be handled differently, as a function of the stoppage time $t_{Sa}$, $t_{Sb}$ or $t_{Sc}$. This applies to the reduction of the rotational speed $n_R$ as well as to the subsequent resumed acceleration of the rotor speed.

The duration of the stoppage is ascertained in the control device 4 from the time at which the yarn monitor 15 (see FIG. 10) is triggered, and from the time at which the control device 4 transmits an impulse to the control device 20 after arrival of the service unit 2 at the spinning station concerned, so that service unit 2 may now start the piecing process. Alternately, it is, of course, also possible for a corresponding impulse to be transmitted from the control device 20 of the service unit 2 to the control device 4, by which the moment of completion of the stoppage period is determined, since the point in time $t_L$ for the switching on of the fiber feeding device 11 occurs at a predetermined time interval from this point in time of switching on the piecing device.

Depending on the measured time period, and also depending on the rotational speed $n_R$ of the spinning rotor 100, the switching on and the acceleration of yarn draw-off are then controlled, whereby the control of rotational speed need not necessarily be in synchronization with the control of yarn draw-off speed when the twist in the yarn 30 is not of importance but the yarn tension after draw-off of the piecing joint 32 from the spinning rotor 100 is still of special importance. The longer the stoppage periods $t_{Sa}$, $t_{Sb}$ or $t_{Sc}$, the later the fiber flow F starts in the spinning rotor and the later must also yarn draw-off begin. Also, the acceleration curve of the fiber flow is flatter with longer stoppage periods, so that the acceleration period of yarn draw-off must also be correspondingly flatter.

The evaluation of the fiber tuft need not be effected indirectly by measuring the stoppage period but can also be effected directly, e.g., by measuring the air resistance of the fiber tuft. The appropriate device by means of which the combed-out state of the fiber tuft is evaluated is suitably connected for control to the control device 4 and/or 20, so that the latter may then be able to control yarn draw-off and rotor speed in an appropriate manner.

As the above description shows, the rotational speed $n_R$ of the spinning rotor 100 can be controlled in different manners. For example, by the slippage of its drive (see FIGS. 8, 9, 10 and 12) and also by intercalating a torque or slippage coupling, can thus be controlled. The spinning rotor 100 can also be braked or accelerated again in a controlled manner by means of a controllable brake (see FIGS. 8 and 13) while the central drive continues to run. It is also possible to provide a motor for independent drive 107 (see FIG. 11) to control the rotational speed of spinning rotor 100.

When precise adaptation of the rotational speed change (speed reduction or acceleration) of the spinning rotor 100 to the speed $V_A$ of the yarn draw-off is desired, it is also possible to monitor the speed of the spinning rotor 100 in case of its slippage being controlled in order to control the rotational speed.

It is also possible to provide a main drive to drive the spinning rotors 100 of several adjacent spinning stations at production speed, while an auxiliary drive is provided, coupled only to the spinning rotor 100 of one single spinning station for the duration of piecing.

The two drives are connected to the control device 4 to control coupling and uncoupling. The speed of the auxiliary drive is controlled during piecing by the control device 4 so that the rotational speed $n_R$ of the spinning rotor 100 is first reduced and is again accelerated at the desired point in time to its full production speed.

When the time control of the rotor speed is not precise, yarn breakage will not necessarily occur immediately, even though the danger of such a yarn breakage is great, even though the prescribed tolerances of the tension $S_F$ have been exceeded. In order to reduce this danger in future piecing operations, the tension $S_F$ in the pieced yarn 30 is monitored during piecing by means of the yarn monitor 15 made in form of a yarn tension monitor. If the detected yarn tension deviates from the desired tension beyond established tolerances, a signal to that effect is transmitted to the control device 4. This causes the rotational speed $n_R$ of the spinning rotor 100 to be controlled accordingly in the next piecing operation, e.g., according to FIG. 5, so that the yarn tension deviations may decrease or disappear.

Depending on the programming, it is further possible to cause the piecing operation (which has just been monitored) to be repeated immediately, or the newly adjusted rotational speed control to be applied only for the repair of a non-provoked yarn breakage.

A value can be entered manually into the control device 4 as a reference value. However, the control device 4 can also contain means which measure the yarn tension during normal spinning operation and store the average value of the measured yarn tension values as a reference value to be compared with the yarn tensions occurring during piecing.

Such a control of the changes in rotor speed can be carried out electronically (e.g., with a motor for independent drive 107) or mechanically by means of a stop (not shown), for instance, by using a belt application device.

We claim:

1. A device for piecing year in an open-end spinning device which has a spinning rotor supported on a rotor shaft with a fiber collection surface, comprising:

(a) means for feeding fibers to said fiber collection surface;

(b) means for backfeeding a piecing yarn to said fiber collection surface to piece said yarn;

(c) means to draw off pieced yarn;

(d) drive means to rotate said spinning rotor; and (e) control means for controlling said drive means to rotate said spinning rotor at a piecing speed during said piecing, and for reducing said rotor speed to a lower speed after said piecing is completed and for accelerating said rotor speed to a predetermined production rotational speed after said rotational speed is lowered.

2. A device as set forth in claim 1, wherein said control means comprises a time control means.

3. A device as set forth in claim 2, wherein said time control means is adjustable for adjusting the time during which said rotor speed is reduced.

4. A device as set forth in claim 2, further comprising:

(a) means for monitoring said rotor speed;

(b) means for monitoring said yarn draw-off speed; and (c) means for comparing said monitored rotor speeds and said monitored yarn draw-off speed with desired production speeds and for converting said monitored speeds into percentage values of said production speed, including means to trigger a switching impulse when each of said percentage values are equal, to end said reduction of rotor speed.

5. A device as set forth in claim 1, further comprising means for monitoring the rotational speed of said rotor.

6. A device as set forth in claim 5, wherein said monitoring means is connected to said control means for producing a rotor speed that is in proportion to said yarn draw-off speed.

7. A device as set forth in claim 6, wherein said drive means for rotating said spinning rotor comprises:

(a) two drive belts, each of which is driven at a different speed; and (b) a two-armed change-over lever for selectively driving the shaft of said spinning rotor by said drive belts

8. A device as set forth in claim 6, further comprising a belt application device having adjusting means to set at least one of the maximum and minimum application pressures between said drive belt and said rotor shaft.

9. A device as set forth in claim 6, wherein said control means is disposed on a service unit which travels alongside a plurality of open-end spinning devices, and said belt application device is connected to a control lever of which an actuating element is controlled by said control device of said service unit.

10. A device as set forth in claim 9 wherein said open-end spinning device comprises a stop to limit the approach of said actuating element.

11. A device as set forth in claim 6, wherein said control means is supported on a service unit which travels alongside a plurality of open-end spinning devices, and said belt application device for each of said open-end spinning devices is provided with one actuating device by which said belt application device is connected to said control device.

12. A device as set forth in claim 11, further comprising an adjustable brake for applying an adjustable braking action on said spinning rotor shaft.

13. A device as set forth in claim 11, wherein said brake lever is movable between a braking position and a lift-off position.

14. A device as set forth in claim 1, wherein said drive means for rotating said spinning rotor comprises a belt drive and said spinning rotor is supported on a rotor shaft which is in driving relation with said belt drive, and further comprising a belt application means which is connected to said control means for controlling the pressure between said belt drive and said rotor shaft.

15. A device for piecing yarn as set forth in claim 1, wherein said drive means comprises:

(1) a drive shaft for supporting said rotor for rotation;

(2) at least one drive belt for driving said drive shaft;

(3) a belt application device comprising a roller lever supporting a belt application roller in a positioning adjacent said belt;

(4) first resilient means for urging said belt application roller against said belt;

(5) braking means disposed adjacent to said rotor drive shaft;

(6) means for moving said braking means into a plurality of positions relative to said roller lever;

(7) a plurality of stops, interacting with said braking lever and said roller lever, for lifting said belt application roller from said belt when said breaking means is moved into its braking position against said roller support shaft;

(8) second resilient means connecting said braking lever with said roller lever, said second resilient means exerting less force than said first resilient means; and (9) means for varying the force exerted upon said drive belt by said first resilient means including means for changing the relative positions of said braking lever and said roller lever.

16. A device as set forth in claim 15, wherein said roller lever comprises two arms, one of which supports said belt application roller and is under the influence of said second resilient means, while said other arm opposite said belt application roller is under the influence of said first resilient means.

17. A device for piecing yarn as set forth in claim 1, wherein said drive means comprises:

(1) at least one drive belt for driving said spinning rotor shaft;

(2) a belt application device having a roller lever which supports a belt application roller which is movable from said belt; and (3) a braking lever which comprises an adjustable damping device.

18. A device as set forth in claim 17, wherein said damping device includes a spring washer mounted on a pivot axle for said roller lever, said spring washer having a load element disposed for displacement parallel to said pivot axle.

19. A device as set forth in claim 1, wherein said control means comprises a generator for generating electrical currents for controlling the rotational speed of said spinning rotor.

20. A device as set forth in claim 1, wherein said drive means comprises two separate drive elements for alternately driving said spinning rotor shaft, one of which is disposed for driving a plurality of adjacent spinning rotors simultaneously while the other of which is disposed to drive only one spinning rotor at a time, and said control means controls the drive of said spinning rotor.

21. A device as set forth in claim 1, further comprising a yarn tension measuring device which is connected to said control means and said control means comprises means for comparing the measured yarn tension with a predetermined reference tension, and means for storing deviations from said predetermined reference tensions so that the reduction of rotor speeds in subsequent piecing operations is controlled by said control means to reduce the deviations between said measured yarn tension and said predetermined reference tension.

22. A device as set forth in claim 21, wherein said control means comprises means for storing the average value of yarn tension measured during normal production of yarn thereon as a reference value.

* * * * *